US011486141B2

(12) United States Patent
Baxter et al.

(10) Patent No.: US 11,486,141 B2
(45) Date of Patent: Nov. 1, 2022

(54) CEILING SYSTEM AND CARRIER COMPONENT THEREOF

(71) Applicant: ARMSTRONG WORLD INDUSTRIES, INC., Lancaster, PA (US)

(72) Inventors: Nathan J. Baxter, Lancaster, PA (US); Stephanie J. Watson, Downingtown, PA (US)

(73) Assignee: AWI Licensing LLC, Wilmington, DE (US)

( * ) Notice: Subject to any disclaimer, the term of this patent is extended or adjusted under 35 U.S.C. 154(b) by 0 days.

(21) Appl. No.: 17/211,504

(22) Filed: Mar. 24, 2021

(65) Prior Publication Data

US 2021/0301525 A1 Sep. 30, 2021

Related U.S. Application Data

(60) Provisional application No. 62/994,626, filed on Mar. 25, 2020.

(51) Int. Cl.
*E04B 9/24* (2006.01)
*E04B 9/04* (2006.01)
(Continued)

(52) U.S. Cl.
CPC ..... *E04B 9/245* (2013.01); *E04B 9/0478* (2013.01); *E04B 9/06* (2013.01); *E04B 9/065* (2013.01);
(Continued)

(58) Field of Classification Search
CPC ..... E04B 9/245; E04B 9/0478; E04B 9/06; E04B 9/065; E04B 9/225; E04B 9/363; E04B 9/068; E04B 9/26; E04B 9/36
See application file for complete search history.

(56) References Cited

U.S. PATENT DOCUMENTS 4,441,297 A 4/1984 Rijnders
4,646,506 A * 3/1987 Slapsys ..... E04B 9/363 52/460
(Continued)

FOREIGN PATENT DOCUMENTS

CN 201024562 Y 2/2008
EP 0137591 B1 3/1989
(Continued)

OTHER PUBLICATIONS

International Search Report for related application No. PCT/2021/023966 dated Jul. 16, 2021.

*Primary Examiner* — Adriana Figueroa
(74) *Attorney, Agent, or Firm* — Craig M. Sterner

(57) ABSTRACT

A carrier component for a ceiling system and/or a ceiling system that includes the carrier component. The carrier component may include a body portion that extends along a first longitudinal axis and a plurality of support members that extend from the body portion in a spaced apart manner. Each of the support members may extend along a second longitudinal axis. Each of the support members may include a distal end, first and second ledges located on opposite sides of the second longitudinal axis, and third and fourth ledges located on opposite sides of the second longitudinal axis, the first and second ledges being closer to the distal end of the support members than the third and fourth ledges. One or more ceiling panels may be coupled to the carrier component via engagement with the first and second ledges or the third and fourth ledges of the support members.

18 Claims, 15 Drawing Sheets

(51) Int. Cl.

| | |
|---|---|
| ***E04B 9/06*** | (2006.01) |
| ***E04B 9/22*** | (2006.01) |
| ***E04B 9/36*** | (2006.01) |
| *E04B 9/26* | (2006.01) |

(52) U.S. Cl.
CPC ..... *E04B 9/225* (2013.01); *E04B 9/363* (2013.01); *E04B 9/068* (2013.01); *E04B 9/26* (2013.01); *E04B 9/36* (2013.01)

(56) References Cited

U.S. PATENT DOCUMENTS

| | | | | |
|---|---|---|---|---|
| 4,671,041 | A | 6/1987 | Rijnders | |
| 6,336,302 | B1 * | 1/2002 | Brugman | E04B 9/26 52/489.1 |
| 6,931,907 | B2 * | 8/2005 | Yuan | E04C 2/08 72/379.2 |
| 10,094,105 | B2 | 10/2018 | Harnish et al. | |
| 10,472,817 | B2 | 11/2019 | Harnish et al. | |
| 10,683,664 | B2 * | 6/2020 | Langeveld | E04B 9/363 |
| 2004/0065038 | A1 | 4/2004 | Yuan | |
| 2004/0172907 | A1 | 9/2004 | Krantz-Lilienthal et al. | |
| 2010/0257808 | A1 | 10/2010 | Baxter et al. | |
| 2019/0024373 | A1 | 1/2019 | Langeveld | |

FOREIGN PATENT DOCUMENTS

| | | | | |
|---|---|---|---|---|
| EP | 0633365 | A2 | 1/1995 | |
| EP | 3498933 | A1 * | 6/2019 | E04B 1/38 |
| EP | 3498933 | A1 | 6/2019 | |
| EP | 3591131 | A1 | 1/2020 | |
| FR | 2811350 | A1 * | 1/2002 | E04B 1/8409 |
| WO | WO-8505391 | A1 * | 12/1985 | |
| WO | WO-2017042268 | A1 * | 3/2017 | E04B 9/065 |

* cited by examiner

CEILING SYSTEM AND CARRIER COMPONENT THEREOF

CROSS-REFERENCE TO RELATED APPLICATIONS

The present application claims priority to U.S. Provisional Patent Application Ser. No. 62/994,626, filed Mar. 25, 2020, the entirety of which is incorporated herein by reference.

BACKGROUND

The present invention generally relates to panel systems such as ceiling or wall systems and brackets for use with such systems. Some panel systems, for example plank type ceiling or wall systems, have carrier components that are attached to main beams that carry the load of the panel system. The carrier components have some type of attachment feature to which a plurality of panels such as, for example, planks, are attached. However, with existing panel systems there is a lack of variation available such that generally only one type of panel is able to be coupled to the carrier component at a specific location therealong. As a result, existing panel systems allow for the creation of a ceiling system having a specific, pre-set aesthetic. Thus, a need exists for a more modular panel system that allows for the creation of ceiling surfaces having different aesthetics.

BRIEF SUMMARY

The present invention is directed to a carrier component for a ceiling system and/or to a ceiling system comprising the carrier component. The carrier component may include a body portion that extends along a first longitudinal axis and a plurality of support members that extend from the body portion. The support members may be spaced apart from one another, and each of the support members may extend along a second longitudinal axis. Furthermore, each of the support members may include a distal end, first and second ledges located on opposite sides of the second longitudinal axis, and third and fourth ledges located on opposite sides of the longitudinal axis. The first and second ledges may form a first mounting element of the support members and the third and fourth ledges may form a second mounting element of the support members. The first and second ledges may be positioned closer to the distal end of the support members than the third and fourth ledges. In the ceiling system, one or more ceiling panels may be coupled to the carrier component via engagement with either the first and second ledges (i.e., the first mounting element) of one or more of the support members or with the third and fourth ledges (i.e., the second mounting element) of one or more of the support members.

In one aspect, the invention may be a carrier component configured to support one or more panels of a ceiling system, the carrier component comprising: a body portion extending along a first longitudinal axis; and a plurality of support members extending from the body portion and arranged in a spaced apart manner along the longitudinal axis, each of the support members extending along a second longitudinal axis and comprising: a distal end; a first ledge and a second ledge located on opposite sides of the second longitudinal axis; and a third ledge and a fourth ledge located on opposite sides of the second longitudinal axis, the third and fourth ledges being located further from the distal end than the first and second ledges.

In another aspect, the invention may be a carrier component configured to support one or more panels of a ceiling system, the carrier component comprising: a body portion extending along a first longitudinal axis; and a plurality of support members extending from the body portion and arranged in a spaced apart manner along the longitudinal axis, each of the support members extending along a second longitudinal axis and comprising: a distal end; a first mounting element configured to support a first panel; and a second mounting element configured to support a second panel, the second mounting element being located further from the distal end than the first mounting element.

In yet another aspect, the invention may be a carrier component configured to support one or more panels of a ceiling system, the carrier component comprising: a body portion extending along a first longitudinal axis; and a first support member extending from the body portion along a second longitudinal axis, the first support member comprising a distal end, a first ledge located on a first side of the second longitudinal axis, and a second ledge located on the first side of the second longitudinal axis, the first ledge being located closer to the distal end than the second ledge; and a second support member extending from the body portion along a third longitudinal axis, the second support member comprising a distal end, a third ledge located on a second side of the third longitudinal axis, and a fourth ledge located on the second side of the third longitudinal axis, the third ledge being located closer to the distal end than the fourth ledge; and wherein the first support member is located on a second side of the second longitudinal axis of the first support member and the first support member is located on a first side of the third longitudinal axis of the second support member, the first and second support members being spaced apart from one another along the first longitudinal axis of the body portion.

In a further aspect, the invention may be a carrier component configured to support one or more panels of a ceiling system, the carrier component comprising: a body portion extending along a first longitudinal axis; and a plurality of support members extending from the body portion and arranged in a spaced apart manner along the first longitudinal axis, each of the support members extending along a second longitudinal axis and comprising: a distal end; a first side edge extending from the distal end in a direction towards the body portion; a first notch formed into the first side edge and terminating at a first end that is located a first distance from the second longitudinal axis; and a second notch formed into the first side edge and terminating at a second end that is located a second distance from the second longitudinal axis, the second distance being greater than the first distance; and wherein each of the first and second notches is configured to receive at least a portion of a mounting element of a panel to mount the panel to the carrier component.

In a still further aspect, the invention may be a ceiling system comprising: a carrier component extending along a first longitudinal axis and comprising a body portion and a plurality of support members extending from the body portion and arranged in a spaced apart manner along the first longitudinal axis, each of the support members comprising a second longitudinal axis; at least one first panel configured to be removably mounted to the carrier component by engagement with one or more of the plurality of support members of the carrier component so that an uppermost edge of the at least one first panel is located at a first axial position along the one or more of the plurality of support members; and at least one second panel configured to be removably mounted to the carrier component by engagement with the one or more of the plurality of support members of the carrier component so that an uppermost edge of the at least one second panel is located at a second axial position along the one or more of the plurality of support members; and wherein the first and second axial positions are different from one another.

In another aspect, the invention may be a ceiling system comprising: a carrier component extending along a first longitudinal axis and comprising a body portion and a plurality of support members extending from the body portion in a spaced apart manner along the first longitudinal axis; and at least one panel removably mounted to the carrier component by simultaneous engagement with a first support member of the plurality of support members and a second support member of the plurality of support members, at least a portion of the first and second support members being located within a cavity of the at least one panel.

In still another aspect, the invention may be a ceiling system comprising: a carrier component extending along a first longitudinal axis and comprising a body portion and a plurality of support members extending from the body portion in a spaced apart manner along the first longitudinal axis, each of the support members comprising a second longitudinal axis; and at least one of: a plurality of a first type of panels; and a plurality of a second type of panels; and wherein the carrier component is configured to support the plurality of the first type of panels at a first axial position along the support members and the plurality of the second type of panels at a second axial position along the support members, the second axial position being different than the first axial position.

In a further aspect, the invention may be a ceiling system comprising: a carrier component extending along a first longitudinal axis and comprising a body portion and a plurality of support members extending from the body portion in a spaced apart manner along the first longitudinal axis, each of the support members comprising a second longitudinal axis, a first mounting element located at a first axial position along the support member, and a second mounting element located at a second axial position along the support member, the first axial position being closer to a distal end of the support member than the second axial position; a plurality of identical panels detachably mounted to the carrier component, the plurality of identical panels comprising: a first panel comprising a first mounting element in engagement with the first mounting element of a first subset of the support members to mount the first panel to the carrier component; and a second panel comprising a second mounting element in engagement with the second mounting element of a second subset of the support members to mount the second panel to the carrier component.

In a still further aspect, the invention may be a ceiling system comprising: a carrier component extending along a first longitudinal axis and comprising a body portion and a plurality of support members extending from the body portion in a spaced apart manner along the first longitudinal axis, each of the support members comprising a second longitudinal axis, a first mounting element located at a first axial position along the support member, and a second mounting element located at a second axial position along the support member, the first axial position being closer to a distal end of the support member than the second axial position; at least one panel configured for detachable coupling to the carrier component via engagement with either the first mounting element of one or more of the support members or the second mounting element of one or more of the support members.

In yet another aspect, the invention may be a ceiling system comprising: a carrier component extending along a first longitudinal axis and comprising a body portion and a plurality of support members extending from the body portion and arranged in a spaced apart manner along the first longitudinal axis, each of the plurality of support members comprising a second longitudinal axis; a plurality of panels configured to be removably mounted to the carrier component by engagement with one or more of the plurality of support members of the carrier component; and wherein the plurality of support members are configured to support the plurality of panels at a plurality of different axial positions along the support members.

In a yet further aspect, the invention may be a ceiling system comprising: a carrier component extending along a first longitudinal axis and comprising a body portion and a plurality of support members extending from the body portion in a spaced apart manner along the first longitudinal axis; a plurality of panels, each of the panels comprising at least one mounting element configured to engage one or more of the plurality of support members to detachably couple the panel to the carrier component; and wherein the plurality of support members are configured to support the plurality of panels at: (1) a first position whereby the at least one mounting element is located at a first elevation along a length of the support member; and (2) a second position whereby the at least one mounting element is located at a second elevation along the length of the support member, the second elevation being different than the first elevation.

In still a further aspect, the invention may be a ceiling system comprising: a carrier component extending along a first longitudinal axis and comprising a body portion and a plurality of support members extending from the body portion in a spaced apart manner along the first longitudinal axis, each of the plurality of support members comprising a distal end, a first mounting element located a first distance from the distal end, and a second mounting element located a second distance from the distal end, the second distance being greater than the first distance; at least one panel comprising a mounting element; and wherein the at least one panel is configured to be detachably mounted to the carrier component in at least two distinct hanging positions comprising: (1) a first hanging position wherein the mounting element of the at least one panel engages the first mounting element of one or more of the plurality of support members; and (2) a second hanging position wherein the mounting element of the at least one panel engages the second mounting element of the one or more of the plurality of support members.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
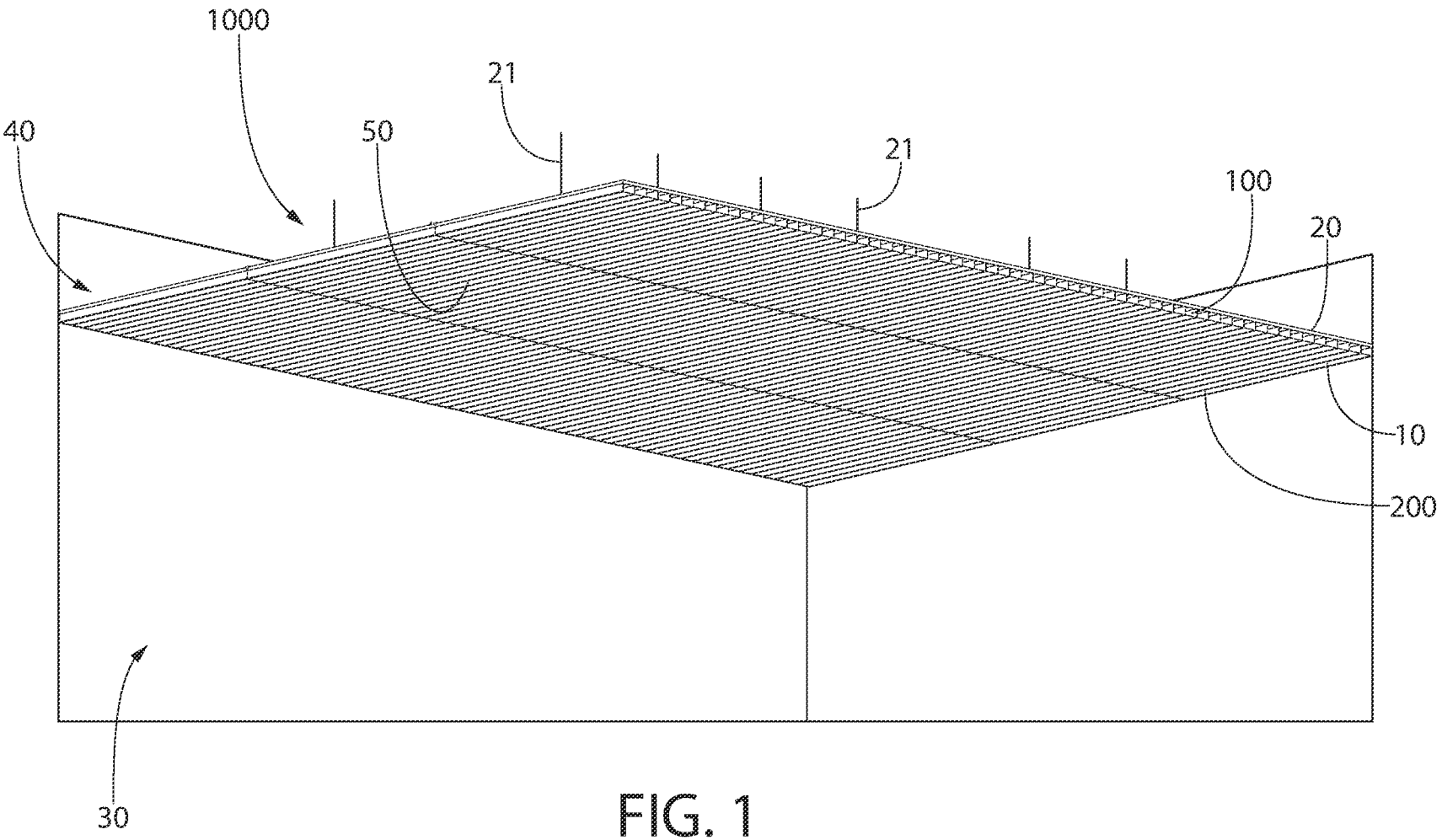
FIG. 1 is a bottom perspective view of a ceiling system installed in an interior environment.

The following description of embodiments is merely exemplary in nature and is in no way intended to limit the invention, its application, or uses.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "coupled," "affixed," "connected," "interconnected," and the like refer to a relationship wherein structures are secured or attached to one another either directly or indirectly through intervening structures, as well as both movable or rigid attachments or relationships, unless expressly described otherwise.

Figure 2:
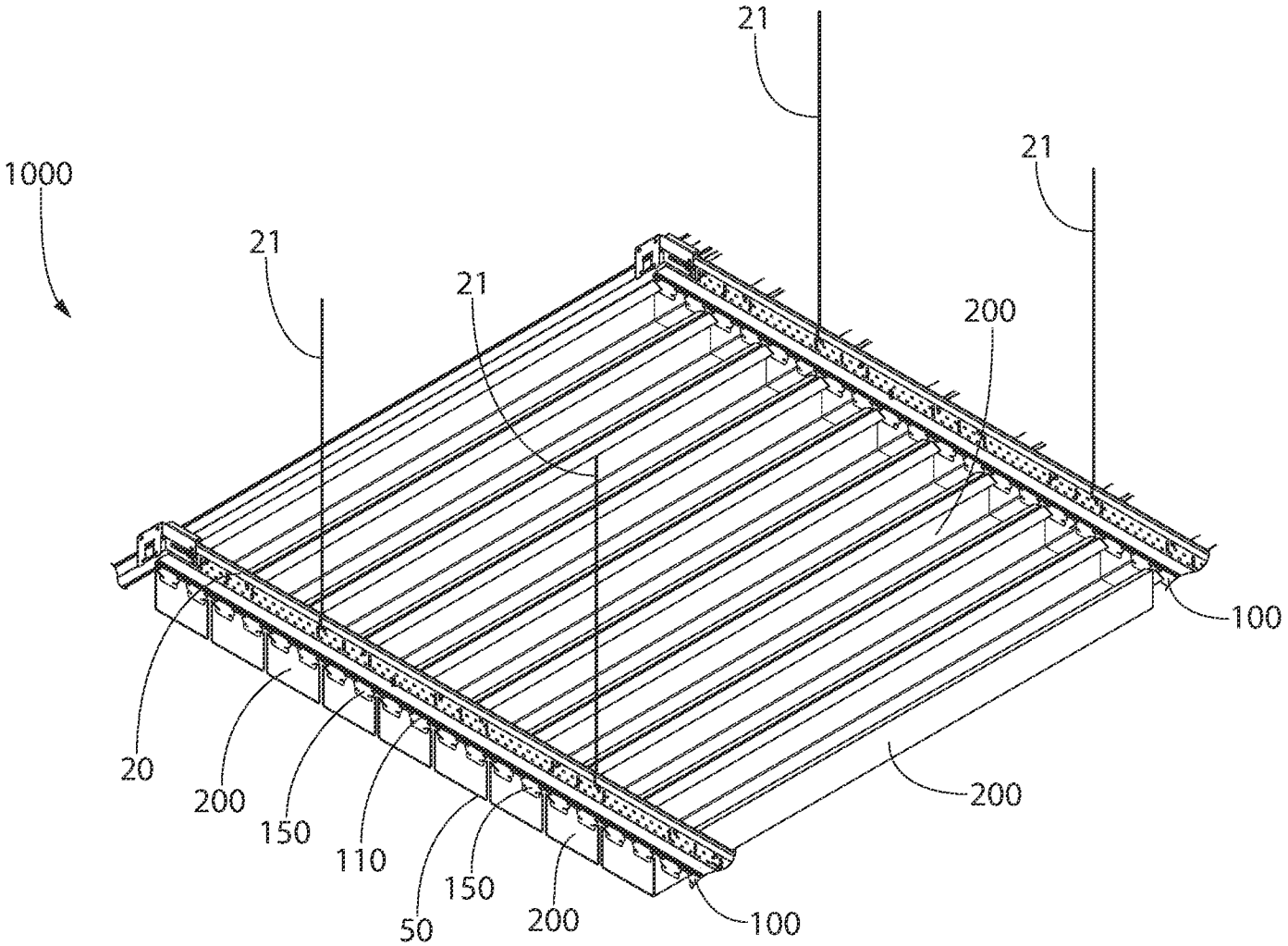
FIG. 2 is a top perspective view of a portion of the ceiling system of FIG. 1.

Referring to FIGS. 1 and 2, a ceiling system 1000 will be described in accordance with an embodiment of the present invention. FIG. 1 illustrates the ceiling system 1000 when viewed from below, with the ceiling system 1000 spanning from wall to wall and separating a building occupied space 30 from a plenum space 40. FIG. 2 illustrates a close-up view of a portion of the ceiling system 1000 when viewed from above the ceiling system 1000. Wiring, ventilation ductwork, and other mechanical systems and the like may be located within the plenum space 40 and hidden behind the ceiling system 1000 so that it can be kept out of view to people in the building occupied space 30. In the exemplified embodiment, the ceiling system 1000 generally comprises a perimeter frame 10, a plurality of main beams 20, a plurality of carrier components 100 coupled to the main beams 20, and a plurality of panels (i.e., ceiling panels) 200 mounted to the carrier components 100. Bottom surfaces of the panels 200 form an exposed ceiling surface 50 for the building occupied space 30. Thus, persons in the building occupied space 30 will look up and see the bottoms of the panels 200 as forming the ceiling of the building occupied space 30.

In the exemplified embodiment, the ceiling system 1000 is a plank system that includes a plurality of the main beams 20 positioned in a parallel and spaced apart arrangement or in a grid-like arrangement. The carrier components 100 are coupled to the main beams 20, and the carrier components 100 support a plurality of the panels 200. The perimeter frames 10 may be coupled directly to the walls of the building space. For example, in a rectangular room the perimeter frame 10 may be attached to each wall to form a rectangular perimeter of the ceiling system 1000. The perimeter frame 10 may also be attached to walls that are located inside or that project into the building space. The main beams 20 may be attached at their wall ends to the perimeter frame 10. Thus, the perimeter frame 10 may provide support for some or all of the weight of the ceiling system 1000 in some embodiments. The main beams 20 may be additionally supported by support elements 21 at positions remote from the walls of the building occupied space. The support elements 21 may be, for example without limitation, wires, cables, tie rods, hangers, struts, or the like that extend from the main beams 20 to a structural support of the building, such as the roof or the like.

In the exemplary embodiment depicted in FIG. 1, the ceiling system 1000 is a flat system such that the exposed ceiling surface 50 is planar and is parallel to the floor of the occupied space 30. In other embodiments, the exposed ceiling surface 50 may be non-planar, sloped, curved, or the like. This can be achieved by modifying a location along the carrier component 100 at which the ceiling panels 200 are attached or by attaching different ceilings panels 200 with different sizes, shapes, or the like to the carrier component 100. In still other embodiments, the components described herein may be used to form a wall system such that the carrier components 100 are coupled to the wall so that the panels 200 form wall coverings. Both ceiling and wall systems may have aesthetic, sound control, insulation, or other properties. For simplicity, the invention will be discussed using a plank type ceiling system as an example. It is noted, however, that the features of the invention also apply to other types of wall systems and other types of ceiling systems. The panels 200 used in building systems in accordance with the invention described herein may be formed from metal, plastic, fabric, wood, acoustical materials, thermally conductive materials, or the like.

Certain features of the invention will be described with a numerical descriptor (first, second, third fourth) before the name of the feature. The numerical descriptor is being used herein to differentiate similar or identical features from one another. Thus, the use of numerical descriptors such as first, second, third, fourth etc. in the claims may be different from the use of those terms in the specification. For example, one feature may be referred to as a fourth ledge in the specification and a second ledge in the claims. The reason for this is to allow for the numerical descriptors to be sequential in the claims.

As shown in FIG. 2, the main beams 20 extend parallel to each other. One or more of the carrier components 100 are coupled to each of the main beams 20, the process of which will be described in greater detail below with reference to FIGS. 4 and 5. Each of the carrier components 100 comprises a body portion 110 and a plurality of support members 150. The panels 200 are mounted to the carrier components 100 via engagement with one or more of the support elements 150. In FIG. 2, each of the panels 200 is coupled to portions of two distinct ones of the support members 150. However, this is not required in all embodiments. In some embodiments, one or more of the panels 200 may be mounted to a single one of the support members 150 while others of the panels 200 are mounted to two distinct ones of the support members 150 (whether the two distinct ones of the support members 150 are adjacent to one another or separated by an intervening support member 150). Moreover, in FIG. 2 all of the panels 200 appear to be identical, thereby forming the planar exposed ceiling surface 50. However, the panels 200 may have different heights and widths or the like in other embodiments to create an exposed ceiling surface that has a contour or a non-planar appearance. Moreover, as will be described in detail below, the panels 200 may be configured for coupling to the carrier components 100 at different axial positions along the support members 150. This may allow different types of panels to attach to the same carrier component 100 and may also allow for the creation of a non-planar exposed ceiling surface despite using all of the same type of panel 200 to do so.

Figure 3:
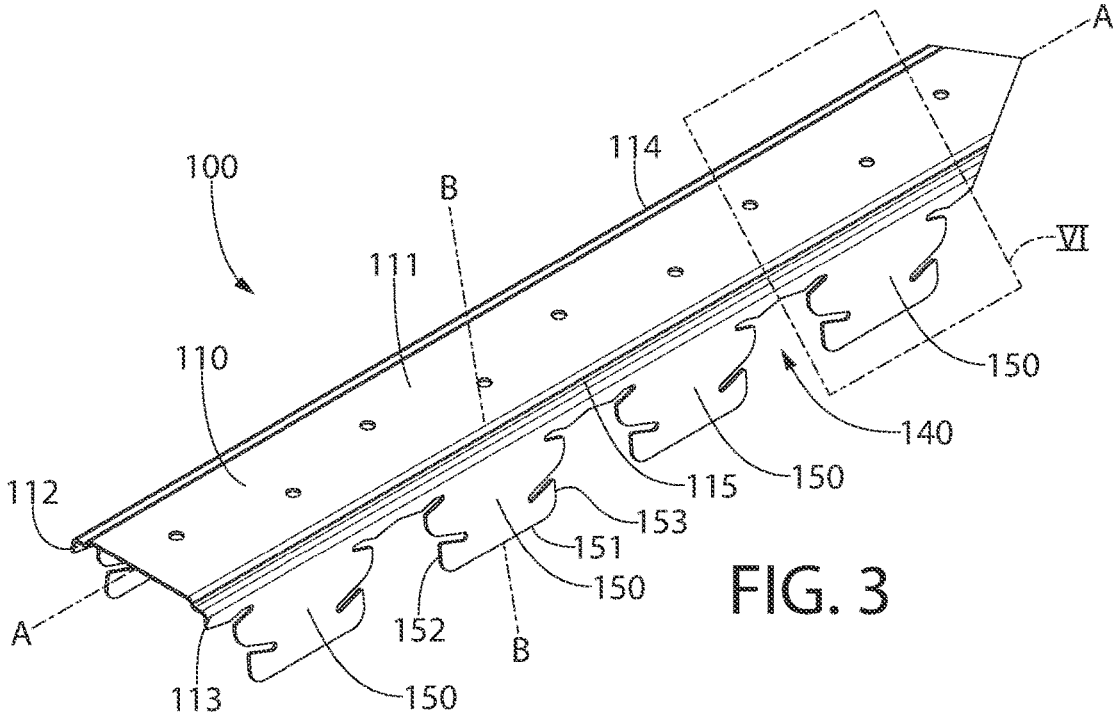
FIG. 3 is a perspective view of a portion of a carrier component of the ceiling system of FIG. 1.
Figure 4:
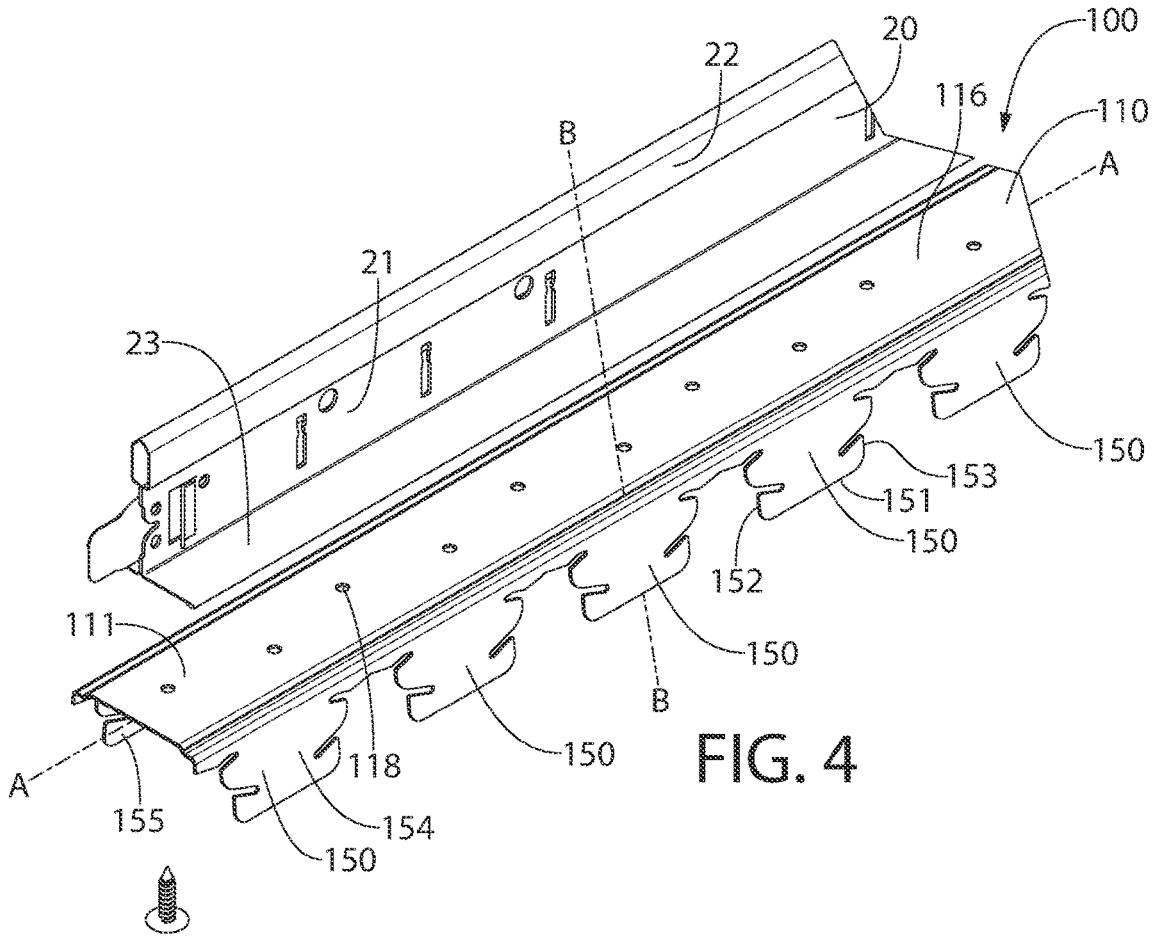
FIG. 4 is a perspective view illustrating the carrier component of the ceiling system of FIG. 1 in preparation for attachment to a main beam of the ceiling system of FIG. 1.
Figure 5:
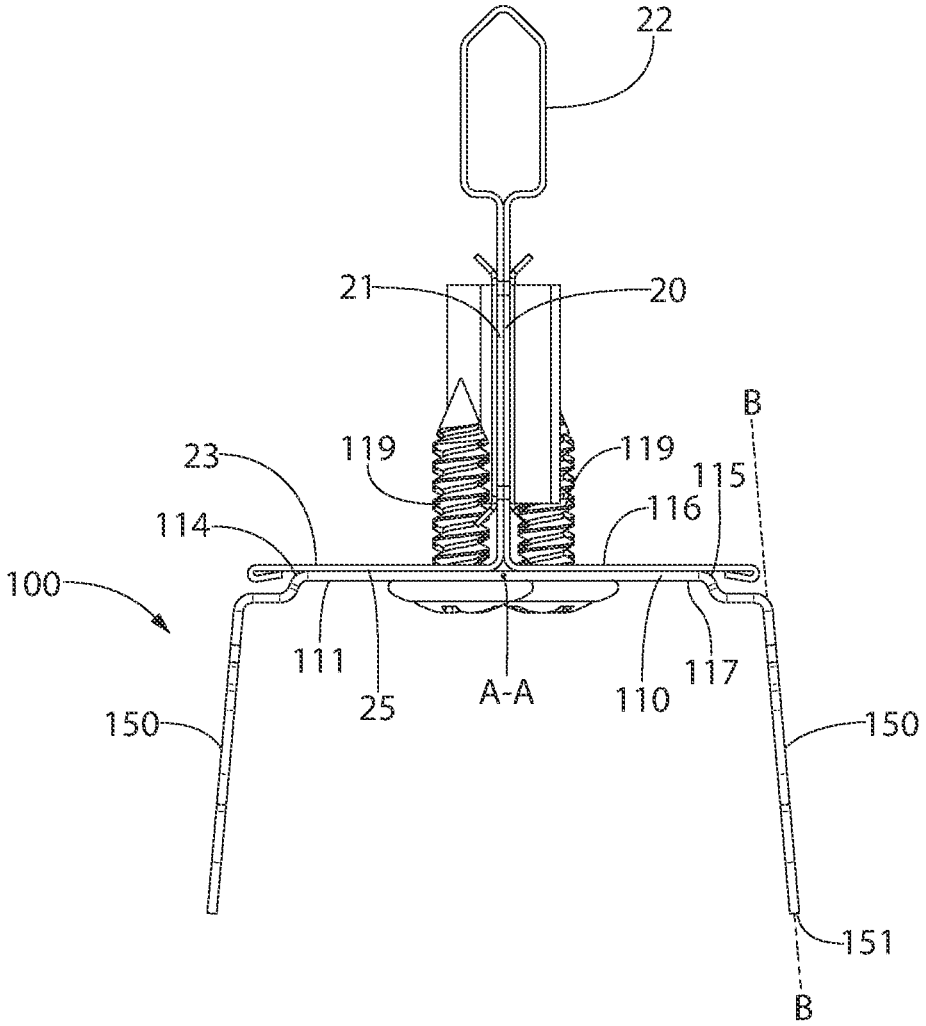
FIG. 5 is a side view of the carrier component coupled to the main beam of the ceiling system of FIG. 1.

Referring to FIGS. 3-5 the carrier component 100 will be described in greater detail, along with the manner in which the carrier component 100 is coupled to the main beam 20. In FIGS. 3 and 4, only a portion of the carrier component 100 is illustrated so that certain features thereof can be readily seen. A more complete view of the carrier component 100 is provide in FIGS. 7A-7C, for example. As mentioned above, the carrier component 100 generally comprises a body portion 110 and a plurality of support members 150. The body portion 110 extends along a first longitudinal axis A-A. In the exemplified embodiment, the body portion 110 comprises a web portion 111, a first sidewall 112 extending downwardly from the web portion 111, and a second sidewall 113 extending downwardly from the web portion 111. The first and second sidewalls 112, 113 could be omitted in some embodiments such that the carrier component 100 may comprise the web portion 111 and the support members 150.

As shown in FIGS. 3 and 4, the plurality of support members 150 extend downwardly from the body portion 110 in a spaced apart manner along the first longitudinal axis A-A of the body portion 110. The web portion 111 of the body portion 110 comprises a first edge 114 located on a first side of the first longitudinal axis A-A and a second edge 115 located on a second side of the first longitudinal axis A-A. The plurality of support members 150 are arranged in pairs such that each of the support members 150 that extends from the first edge 114 of the web portion 111 of the body portion 110 is aligned with one of the support members 150 that extends form the second edge 115 of the web portion 111 of the body portion 110. This arrangement ensures that the panels 200 are adequately supported by the support members 150 because each of the panels 200 will be supported by at least one support member 150 that extends from the first edge 114 and at least one support member 150 that extends from the second edge 115. Thus, in the exemplified embodiment there are a plurality of the support members 150 extending from the first edge 114 of the web portion 111 and a plurality of the support members 150 extending from the second edge 115 of the web portion 111.

Each of the support members 150 extends from the body portion 110 to a distal end 151 of the support member 150 along a second longitudinal axis B-B. In the exemplified embodiment, the second longitudinal axis B-B is approximately perpendicular to the first longitudinal axis A-A such that the support members 150 extend approximately perpendicularly form the body portion 110. By "approximately perpendicular" it is intended that the second longitudinal axis B-B is oriented at an angle between 85° and 95° relative to the first longitudinal axis A-A. The distal end 151 of the support member 150 is the end or edge of the support member 150 that is located furthest from the body portion 110 of the carrier component 100. The support members 150 further comprise a first side edge 152 extending from the body portion 110 to the distal end 151 and a second side edge 153 extending from the body portion 110 to the distal end 151. The first and second side edges 152, 153 are located on opposite sides of the second longitudinal axis B-B of the support members 150. As mentioned previously, the support members 150 are arranged so as to be spaced apart from one another along the first longitudinal axis A-A. Thus, the first side edge 152 of each of the support members 150 is spaced apart from the second side edge 153 of an adjacent one of the support members 150 by a gap 140. During mounting of the panels 200 onto the carrier component 100, the panels 200 may be inserted into the gaps 140.

Referring to FIGS. 4 and 5, the web portion 111 of the body portion 110 of the carrier component 100 comprises a top surface 116 and a bottom surface 117. Furthermore, the web portion 111 of the body portion 110 of the carrier component 100 comprises a plurality of mounting holes 118 extending through the web portion 111 from the top surface 116 to the bottom surface 117. The mounting holes 118 are configured to receive fasteners 119 used to couple or otherwise mount the carrier component 110 to the main beams 20.

In the exemplified embodiment, the main beams 20 are inverted T grid style beams that comprise a web portion 21, an upper portion (or bulb portion) 22 at an upper end of the web portion 21, and a flange 23 extending perpendicularly from a lower end of the web portion 21 in both directions. Thus, the main beams 20 form the shape of an upside-down "T." A bottom surface of the main beams 20 forms an engagement surface 25 that is configured to mate, engage, or face the carrier components in an adjacent manner when the carrier components 200 are coupled to the main beam 20. The main beams 20 are elongated similarly to the carrier components 100. Of course, other styles of main beams 20 may be used as a part of the ceiling system 1000 described herein so long as the carrier components 200 are configured to be coupled or mounted thereto.

The carrier components 200 are coupled to or mounted to the main beams 20 by placing the top surface 116 of the web portion 111 of the carrier component 100 adjacent to or in contact with the engagement surface 25 of the main beam 20. Next, a plurality of the fasteners 119 are inserted through the mounting holes 118 in the carrier component 100 and into the main beam 20 to couple the carrier component 100 to the main beam 20. In the exemplified embodiment, the fasteners 119 are screws, although other fastener elements may be used in other embodiments including nails, bolts, rivets, clamps, or the like. Furthermore, although the fasteners 119 are used for coupling the carrier component 100 to the main beam 20 in the exemplified embodiment, the invention is not to be so limited in all embodiments and in certain other embodiments the carrier component 100 may be coupled to the main beam 20 using a mechanical mating between portions of the carrier component 100 an the main beam 20. As seen in FIG. 5, when the carrier component 100 is coupled to the main beam 20, the support members 150 extend downwardly from the carrier component 100 and hence also from the main beam 20. FIG. 5 also illustrates the alignment of two of the support members 150 that extend from opposite edges (i.e., the first and second edges 114, 115) of the web portion 111 of the body portion 110 of the carrier component 100.

Figure 6:
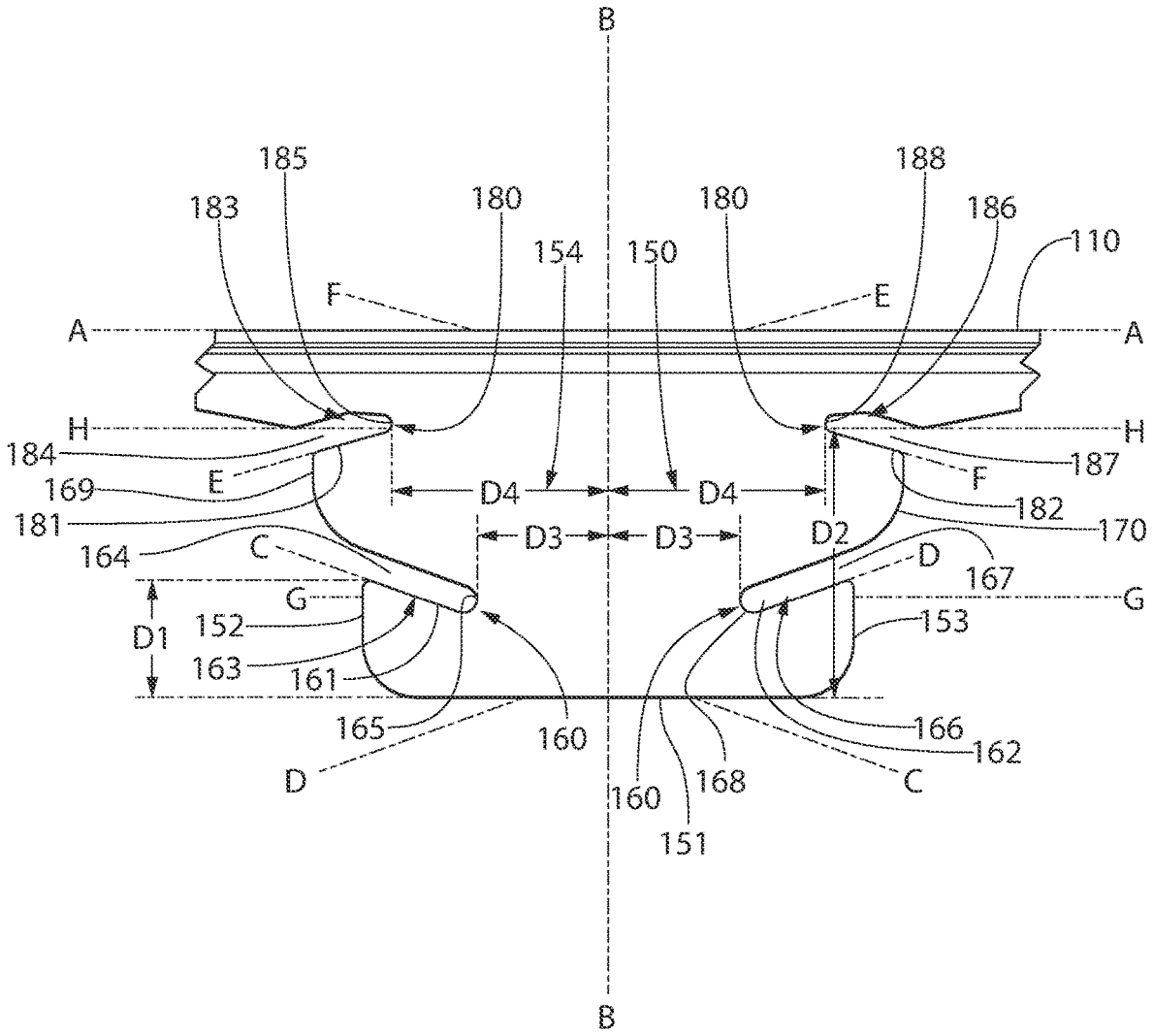
FIG. 6 is a close-up front view of area VI of FIG. 3.

Referring to FIG. 6, one of the support members 150 will be described in more detail, it being understood that the description of the support member 150 with reference to FIG. 6 may be applicable to each and every one of the support members 150 in some embodiments. As mentioned previously, the support members 150 comprise the distal end 151 and the second longitudinal axis B-B extending along a length of the support members 150 from the body portion 110 to the distal end 151. The support members 150 generally extend perpendicularly from the body portion 110, and thus the second longitudinal axis B-B is generally perpendicular to the first longitudinal axis A-A of the body portion 110. The support members 150 further comprise the first side edge 152 that extends form the body portion 110 to the distal end 151 and the second side edge 152 that extends from the body portion 110 to the distal edge 151. The first and second side edges 152, 153 are located on opposite sides of the second longitudinal axis B-B. Furthermore, the support members 150 comprise a front surface 154 and a rear surface 155 (labeled in FIG. 4) opposite the front surface 154.

The support members 150 are generally thin, flat, plate-like members that extend from the body portion 110 of the carrier component 100. Thus, a thickness of the support members 150 measured between the front and rear surfaces 154, 155 of the support members 150 may be small, such as between 0.1 mm and 5 mm, or more specifically between 0.1 mm and 3 mm, or still more specifically between 0.1 mm and 2 mm. The support members 150 have a length measured from the body portion 110 to the distal end 151 and a width measured from the first side edge 152 to the second side edge 153.

The support member 150 comprises a first mounting element 160 and a second mounting element 180, each of the first and second mounting elements 160, 180 being configured to support one of the panels 200 as described in greater detail herein. Thus, a single panel 200 may be supported entirely by the first mounting element 160 of one of the support members 150, entirely by the second mounting element 180 of one of the support members 150, or collectively by portions of the first mounting elements 160 of multiple ones of the support members 150, or collectively by portions of the second mounting elements 180 of multiple ones of the support members 150. In some embodiments, a single panel will not be supported by both the first and second mounting elements 160, 180. This will be better understood from the description below with specific reference to FIGS. 7A-7C.

In the exemplified embodiment, the first mounting element 160 comprises a first ledge 161 located on a first side of the second longitudinal axis B-B and a second ledge 162 located on a second side of the second longitudinal axis B-B. Specifically, the first ledge 161 is formed by a first notch 163 formed into the first side edge 152 of the support member 152. The first notch 163 extends from the first side edge 152 in a direction towards the second longitudinal axis B-B. The first notch 163 extends from an opening 164 in the first side edge 152 to a terminal end 165 that is located between the second longitudinal axis B-B and the first side edge 152. In the exemplified embodiment, the first notch 163 is angled or inclined relative to the second longitudinal axis B-B, although the invention is not to be so limited in all embodiments and the first notch 163 could be oriented perpendicularly relative to the second longitudinal axis B-B in other embodiments. In the exemplified embodiment, the first notch 163 is angled downwardly as it extends further from the first side edge 152 such that the further the first notch 163 is from the first side edge 152 the closer the first notch 163 is to the distal end 151 of the support member 150.

The first ledge 161 is formed by a lower boundary or lower edge of the first notch 163. Thus, the first ledge 161 is also angled relative to the second longitudinal axis B-B in the exemplified embodiment. Specifically, the first ledge 161 extends along a first ledge axis C-C. The first ledge axis C-C is angled relative to the second longitudinal axis B-B such that a distance measured from the distal end 151 of the support member 150 to the first ledge axis C-C decreases as the distance between the first ledge axis C-C and the second longitudinal axis B-B decreases.

The second ledge 162 is formed by a second notch 166 formed into the second side edge 153 of the support member 152. The second notch 166 extends from the second side edge 153 in a direction towards the second longitudinal axis B-B. The second notch 166 extends from an opening 167 in the second side edge 153 to a terminal end 168 that is located between the second longitudinal axis B-B and the second side edge 153. In the exemplified embodiment, the second notch 166 is angled or inclined relative to the second longitudinal axis B-B, although the invention is not to be so limited in all embodiments and the second notch 166 could be oriented perpendicularly relative to the second longitudinal axis B-B in other embodiments. In the exemplified embodiment, the second notch 166 is angled downwardly as it extends further from the second side edge 153 such that the further the second notch 166 is from the second side edge 153 the closer the second notch 166 is to the distal end 151 of the support member 150.

The second ledge 162 is formed by a lower boundary or lower edge of the second notch 166. Thus, the second ledge 162 is also angled relative to the second longitudinal axis B-B in the exemplified embodiment. Specifically, the second ledge 162 extends along a second ledge axis D-D. The second ledge axis D-D is angled relative to the second longitudinal axis B-B such that a distance measured from the distal end 151 of the support member 150 to the second ledge axis D-D decreases as the distance between the second ledge axis D-D and the second longitudinal axis B-B decreases. The first and second ledge axes C-C, D-D converge as they extend from the respective first and second side edges 152, 153 towards the second longitudinal axis B-B of the support member 150. The first and second ledge axes C-C, D-D intersect at an oblique angle in the exemplified embodiment, which may be an obtuse angle in some embodiments.

In the exemplified embodiment, the second mounting element 180 comprises a third ledge 181 located on the first side of the second longitudinal axis B-B and a fourth ledge 182 located on the second side of the second longitudinal axis B-B. Thus, the first and third ledges 161, 181 are located on the first side of the second longitudinal axis B-B and the second and fourth ledges 162, 182 are located on the second side of the second longitudinal axis B-B. As will be described further below, panels 200 can be mounted to the carrier component 200 via engagement with the first and second ledges 161, 162 or via engagement with the third and fourth ledges 181, 182. Generally, a single panel will not engage with one of the first and second ledges 161, 162 and one of the third and fourth ledges 181, 182.

The third ledge 181 is formed by a third notch 183 formed into the first side edge 152 of the support member 152. The third notch 183 extends from the first side edge 152 in a direction towards the second longitudinal axis B-B. The third notch 183 extends from an opening 184 in the first side edge 152 to a terminal end 185 that is located between the second longitudinal axis B-B and the first side edge 152. In the exemplified embodiment, the third notch 183 is angled or inclined relative to the second longitudinal axis B-B, although the invention is not to be so limited in all embodiments and the third notch 183 could be oriented perpendicularly relative to the second longitudinal axis B-B in other embodiments. In the exemplified embodiment, the third notch 183 is angled upwardly as it extends further from the first side edge 152 such that the further the third notch 183 is from the first side edge 152 the further the third notch 183 is from the distal end 151 of the support member 150.

The third ledge 181 is formed by a lower boundary or lower edge of the third notch 183. Thus, the third ledge 181 is also angled relative to the second longitudinal axis B-B in the exemplified embodiment. Specifically, the third ledge 161 extends along a third ledge axis E-E. The third ledge axis E-E is angled relative to the second longitudinal axis B-B such that a distance measured from the distal end 151 of the support member 150 to the third ledge axis E-E increases as the distance between the third ledge axis E-E and the second longitudinal axis B-B decreases.

The fourth ledge 182 is formed by a fourth notch 186 formed into the second side edge 153 of the support member 152. The fourth notch 166 extends from the second side edge 153 in a direction towards the second longitudinal axis B-B. The fourth notch 186 extends from an opening 187 in the second side edge 153 to a terminal end 188 that is located between the second longitudinal axis B-B and the second side edge 153. In the exemplified embodiment, the fourth notch 186 is angled or inclined relative to the second longitudinal axis B-B, although the invention is not to be so limited in all embodiments and the fourth notch 186 could be oriented perpendicularly relative to the second longitudinal axis B-B in other embodiments. In the exemplified embodiment, the fourth notch 186 is angled upwardly as it extends further from the second side edge 153 such that the further the fourth notch 186 is from the second side edge 153 the further the fourth notch 186 is from the distal end 151 of the support member 150.

The fourth ledge 182 is formed by a lower boundary or lower edge of the fourth notch 186. Thus, the fourth ledge 182 is also angled relative to the second longitudinal axis B-B in the exemplified embodiment. Specifically, the fourth ledge 182 extends along a fourth ledge axis F-F. The fourth ledge axis F-F is angled relative to the second longitudinal axis B-B such that a distance measured from the distal end 151 of the support member 150 to the fourth ledge axis F-F increases as the distance between the fourth ledge axis F-F and the second longitudinal axis B-B decreases. The third and fourth ledge axes E-E, F-F converge as they extend from the respective first and second side edges 152, 153 towards the second longitudinal axis B-B of the support member 150. The third and fourth ledge axes E-E, F-F intersect at an oblique angle in the exemplified embodiment, which may be an obtuse angle in some embodiments.

Although in the exemplified embodiment the first and second mounting elements 160, 180 of the support members 150 comprise ledges, the invention is not to be so limited in all embodiments. The first and second mounting elements 160, 180 may be any structure or mechanical features that facilitate the mounting of the panels 200 to the support members 150 of the carrier component 100. Thus, the mounting elements 160, 180 may be protrusions such as nubs extending from the side edges 152, 153 of the support members 150 that engage openings or protrusions on the panels 200. The mounting elements 160, 180 could be openings that receive protrusions extending from the sidewalls of the panels 200. Furthermore, the above is not intended to be an exhaustive list of the types of features that may form the first and second mounting elements 160, 180 of the support members 150. Again, any structure, feature, or the like that allows for the panels 200 to be mounted to the support members 150 may form the first and second mounting elements 160, 180.

As seen in the figures, each of the first, second, third, and fourth notches 163, 166, 183, 186 extend through the support member 150 from the front surface 154 to the rear surface 155. Furthermore, each of the first, second, third, and fourth notches 163, 166, 183, 186 has its own distinct opening in one of the first and second side edges 152, 153. Thus, there is a central portion 169 of the first side edge 152 located between the opening 164 of the first notch 163 and the opening 184 of the third notch 183. Similarly, there is a central portion 170 of the second side edge 153 located between the opening 167 of the second notch 166 and the opening 187 of the fourth notch 186. The first and third notches 163, 183 are distinct elongated slits formed into the first side edge 152 and the second and fourth notches 166, 186 are distinct elongated slits formed into the second side edge 153.

Although in the exemplified embodiment the first, second, third, and fourth ledges 161, 162, 181, 182 are formed by the first, second, third, and fourth notches 163, 166, 183, 186, the invention is not to be so limited in all embodiments. In other embodiments, the first, second, third, and fourth ledges 161, 162, 181, 182 may be formed by protrusions extending from the first and/or second side edges 152, 153 of the support members 150 rather than notches formed into the first and/or second side edges 152 153. Thus, the first, second, third, and fourth ledges 161, 162, 181, 182 may be any surface that is elongated in a direction that is perpendicular or oblique relative to the second longitudinal axis B-B of the support member 150 so that it is configured for mating engagement with the various mounting features of the panels 200.

As will be discussed in more detail below with reference to FIGS. 7A and 7B, in the exemplified embodiment the first and second ledges 161, 162 of the first mounting element 160 are configured to engage with a first type of panel to support the first type of panel and the third and fourth ledges 181, 182 of the second mounting element 180 are configured to engage with a second type of panel to support the second type of panel. In the exemplified embodiment, the first and second ledges 161, 162 of the first mounting element 160 are unable to (i.e., prevented from) engage with the second type of panel and the third and fourth ledges 181, 182 of the second mounting element 180 are unable to (i.e., prevented from) engage with the first type of panel. In the exemplified embodiment, this is achieved by having the first and second ledges 161, 162 angled downwardly from the respective first and second side edges 152, 153 towards the second longitudinal axis B-B whereas the third and fourth ledges 181, 182 are angled upwardly from the respective first and second side edges 152, 153 towards the second longitudinal axis B-B. The first type of panels are configured with mounting elements or features that can engage with the downwardly sloped first and second ledges 161, 162 whereas the second type of panels may be configured with mounting elements or features that can engaged with the upwardly sloped third and fourth ledges 181, 182.

The first and second ledges 161, 162 are aligned along a length of the support member 150 such that a first transverse axis G-G that is perpendicular to the second longitudinal axis B-B of the support member 150 intersects each of the first and second ledges 161, 162. The third and fourth ledges 181, 182 are aligned along a length of the support member 150 such that a second transverse axis H-H that is perpendicular to the second longitudinal axis B-B of the support member 150 intersects each of the third and fourth ledges 181, 182. The first transverse axis G-G is located closer to the distal end 151 of the support member 150 than the second transverse axis H-H.

Thus, the first and second ledges 161, 162 are located closer to the distal end 151 of the support member 150 (and further from the body portion 110 of the carrier component 100) than the third and fourth ledges 181, 182. Specifically, in the exemplified embodiment a maximum distance D1 measured from each of the first and second ledges 161, 162 to the distal end 151 of the support member 150 is less than a maximum distance D2 measured from each of the third and fourth ledges 181, 182 to the distal end 151 of the support member 150. In fact, in the exemplified embodiment the maximum distance D1 is less than a minimum distance measured between the third and fourth ledges 181, 182 and the distal end 151 of the support member 150. Thus, if a panel is in engagement with the first and second ledges 161, 162 it will hang lower within the interior space than if the panel is in engagement with the third and fourth ledges 181, 182 (assuming, of course, that the panels are identical in size/height/length).

Moreover, in the exemplified embodiment, an end of the first and second ledges 161, 162 that is located closest to the second longitudinal axis B-B is located at a distance D3 from the second longitudinal axis B-B. An end of the third and fourth ledges 181, 182 that is located closest to the second longitudinal axis B-B is located at a distance D4 from the second longitudinal axis B-B. Thus, the first and second notches 163, 166 extend deeper into the support member 150 than the third and fourth notches 183, 186. This may be an additional feature that ensures that certain panel types are able to engage the first and second ledges 161, 162 but unable to engage the third and fourth ledges 181, 182, and vice versa.

Figure 7A:
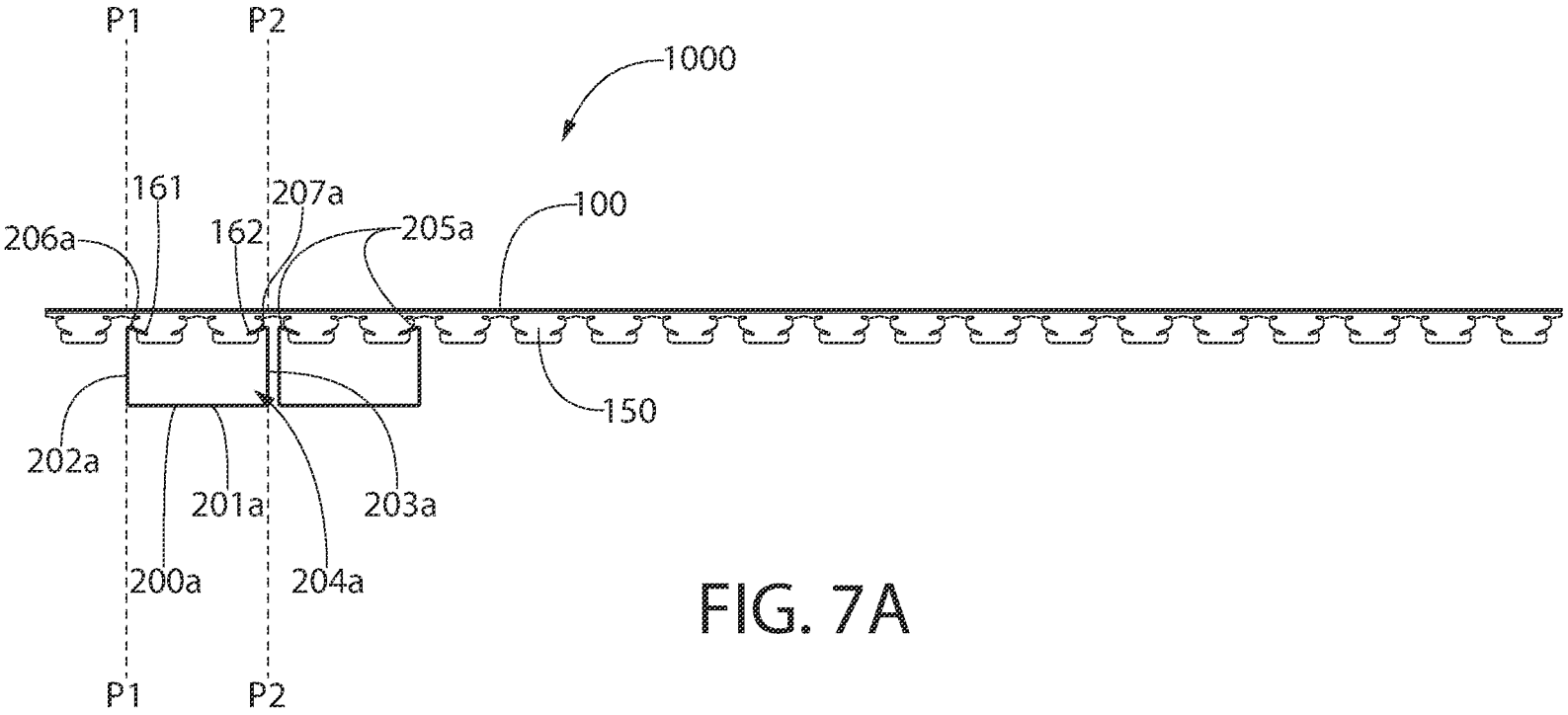
FIG. 7A is a front view of the carrier component of FIG. 3 with a plurality of ceiling panels mounted thereon at a first axial position.

Turning to FIG. 7A, the carrier component 100 is illustrated with two panels 200*a* mounted thereon. In this embodiment, both of the panels 200*a* are identical in every way. Thus, the panels 200*a* have an identical height, width, length, and identical features configured for mounting to the carrier component 100. Thus, the panels 200*a* have a bottom wall 201*a* that forms a bottom surface of the panels 200*a*, a first sidewall 202*a* extending from the bottom wall 201*a* towards the carrier component 100, and a second sidewall 203*a* extending from the bottom wall 201*a* towards the carrier component 100. The first and second sidewalls 202*a*, 203*a* are spaced apart from one another so that a cavity 204*a* is formed by inner surface of the first and second sidewalls 202*a*, 203*a* and an upper surface of the bottom wall 201*a*. Each of the panels 200*a* comprises a mounting element 205*a* that engages the first mounting element 160 of one or more of the support members 150 of the carrier component 100. More specifically, the mounting element 205*a* comprises a first flange 206*a* extending from a distal end of the first sidewall 202*a* and a second flange 207*a* extending from a distal end of the second sidewall 203*a*.

The panels 200*a* are mounted to the carrier component 100 by engagement between the first flange 206*a* of the panel 200*a* with the first ledge 161 of one of the support members 160 and by engagement between the second flange 207*a* of the panel 200*a* with the second ledge 162 of one of the support members 160. Specifically, in this embodiment the first and second flanges 206*a*, 207*a* extend inwardly towards the cavity 204*a* and downwardly towards the bottom wall 201*a* at an angle relative to the first and second sidewall 202*a*, 203*a* from which it extends. As a result, the first and second flanges 206*a*, 207*a* are angled in the same direction as the first and second notches 163, 166 and the first and second ledges 161, 162 to allow for an appropriate engagement between the first and second flanges 206*a*, 207*a* of the panel 200*a* and the first and second ledges 161, 162 of the support members 150. Because the first and second flanges 206*a*, 207*a* extend inwardly and downwardly as described, they are unable to come into engagement with the third and fourth ledges 181, 182 of the support members 150. Specifically, any attempt to mount the panels 200*a* to the third and fourth ledges 181, 182 will not result in an acceptable mounting of the panels 200*a* to the carrier component 100 because the first and second flanges 206*a*, 207*a* will not matingly engage with the third and fourth ledges 181, 182 in an acceptable manner.

In this embodiment, the panel 200*a* is coupled to two different ones of the support members 150. However, in other embodiments panels having a smaller width may be used so that they can be coupled to the first and second ledges 161, 162 of the same support member 150 (see, for example, panel 200*d* shown in FIG. 7C). In the exemplified embodiment, the panels 200*a* are coupled to two adjacent ones of the support members 150. Specifically, the panels 200*a* are coupled to the first ledge 161 of one of the support members 150 and to the second ledge 162 of another one of the support members 150. In other embodiments, the panels 200*a* may have an even greater width and be coupled to two support members 150 that are spaced further apart such that additional support members 150 are positioned between the two support members 150 to which the panel 200*a* is attached.

As seen in FIG. 7A, where the panels 200*a* are coupled to two adjacent support members 150, both of those support members 150 are located within the cavity 204*a* defined by the panel 200*a*. This is because the panels 200*a* are attached to outside surfaces of the two support members 150 that are furthest away from each other. To state this another way, the first sidewall 202*a* of the panel 200*a* lies in a first plane P1-P1 and the second sidewall 203*a* of the panel 200*a* lies in a second plane P2-P2, whereby the two support members 150 to which the panel 200*a* is mounted and any other support members located between the two support members 150 to which the panel 200*a* is mounted are located entirely between the first and second planes P1-P1, P2-P2. As stated previously, the bottom surfaces of the bottom walls 201*a* of the panels 200*a* collectively form the exposed ceiling surface with the bottom surface of each of the panels 200*a* forming a portion of the exposed ceiling surface.

Figure 7B:
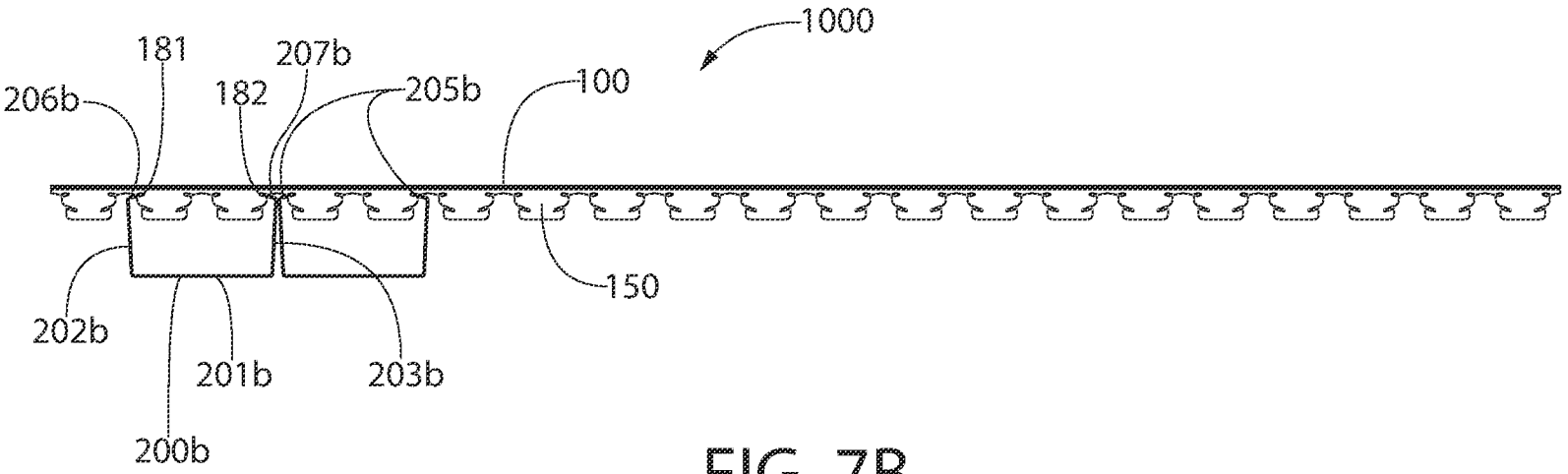
FIG. 7B is a front view of the carrier component of FIG. 3 with a plurality of ceiling panels mounted thereon at a second axial position.

Referring to FIG. 7B, another embodiment is depicted whereby two panels 200*b* are coupled to the carrier component 100. In this embodiment, the panels 200*b* comprise a bottom wall 201*b*, first and second sidewalls 202*b*, 203*b* extending from the bottom wall 201*b* in a direction towards the carrier component 100, and a mounting element 205*b* comprising a first flange 206*b* and a second flange 207*b*. The panels 200*b* may differ from the panels 200*a* in one characteristic. Thus, the panels 200*a* may be described as a first type of panel and the panels 200*b* may be described as a second type of panel, such that the first and second types of panels differ from each other in one characteristic. This characteristic may be a height, length, width, appearance, texture, or the like of the panels in some embodiments. In other embodiments, the difference in at least one characteristic may be a difference in a structure of the mounting elements 205*a*, 205*b*.

More specifically, as described above, the first and second flanges 206*a*, 207*a* of the panels 200*a* extend inwardly and downwardly from the first and second sidewalls 202*a*, 203*a*. Differently, the first and second flanges 206*b*, 207*b* of the panels 200*b* extend inwardly and upwardly from the first and second sidewalls 202*b*, 203*b*. Thus, the first and second flanges 206*b*, 207*b* (i.e., mounting elements 205*b*) of the panels 200*b* are structurally different than the first and second flanges 206*a*, 207*a* (mounting elements 205*a*) of the panels 200*a*. As a result, the first and second flanges 206*b*, 207*b* of the panels 200*b* extend at an angle that is configured for proper engagement with the third and fourth ledges 181, 182 of the support members 150. However, the first and second flanges 206*b*, 207*b* are unable to matingly engage with the first and second ledges 161, 162 of the support members 150. Thus, the first and second ledges 161, 162 are configured to prevent and prohibit engagement with the mounting element 205*b* of the panels 200*b* and the third and fourth ledges 181, 182 are configured to prevent and prohibit engagement with the mounting element 205*a* of the panels 200*a*.

In some embodiments, the ceiling system 1000 may comprise only the panels 200*a* such that all of the panels 200*a* are identical. In some embodiments the ceiling system 1000 may comprise only the panels 200*b* such that all of the panels are identical. In such embodiments, the exposed ceiling surface of the ceiling system 1000 will be planar. In yet other embodiments, the ceiling system 1000 may comprise one or more of the panels 200*a* and one or more of the panels 200*b* and possibly one or more additional different types of panels that differ from the panels 200*a*, 200*b* in one or more characteristic, which may include height, width, length, or the like. In such embodiments, the ceiling system 1000 may have a non-planar exposed ceiling surface that is formed by the ceiling panels 200*a* having different heights.

Figure 7C:
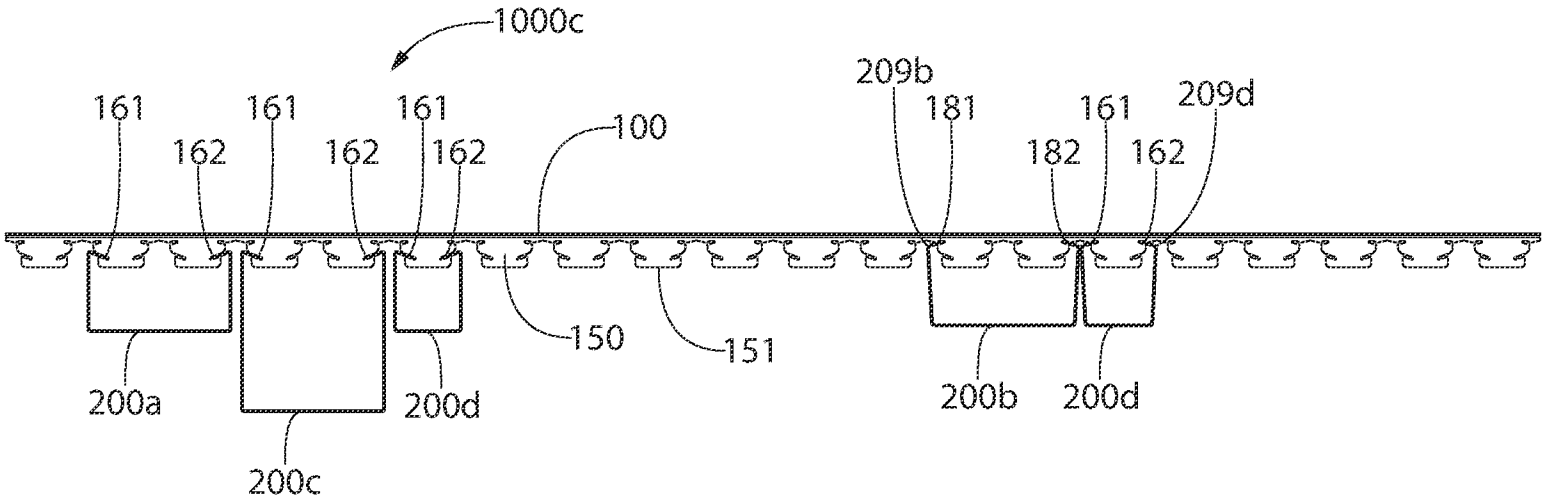
FIG. 7C is a front view of the carrier component of FIG. 3 with a plurality of different ceiling panels mounted thereon at different axial positions.

Referring to FIG. 7C, one such embodiment of a ceiling system 1000*c* is illustrated that has one of the panels 200*a*, one of the panels 200*b*, and additional panels 200*c* and 200*d* mounted to the carrier component 100*c*. In this embodiment, the panel 200*a* is coupled to two of the support members 150 via engagement with the first ledge 161 of one of the support members 150 and the second ledge 162 of the other one of the support members 150. The panel 200*b* is coupled to two of the support members 150 via engagement with the third ledge 181 of one of the support members 150 and the fourth ledge 182 of the other one of the support members 150. The panel 200*c* is coupled to two of the support members 150 via engagement with the first ledge 161 of one of the support members 150 and the second ledge 162 of the other one of the support members 150. Finally, the panels 200*d* are coupled to one of the support members 150 via engagement with the first and second ledges 161, 162 of the support member 150. Thus, the embodiment of FIG. 7C is intended to illustrate the various ways that different types of the panels 200*a-d* can be mounted to the carrier component 100.

For example, the panels 200*a*, 200*c*, 200*d* are illustrated mounted to the carrier component 100 in an adjacent manner. Furthermore, each of the panels 200*a*, 200*c*, 200*d* is coupled to the first and second ledges 161, 162 of various ones of the support members 150 such that the panels 200*a*, 200*c*, 200*d* are coupled to the support members 150 at the same axial position along the support members 150. However, the panels 200*a*, 200*c* have a greater width than the panel 200*d*. Furthermore, the panel 200*c* has a greater height than the panels 200*a*, 200*d*. As a result, using these different types of panels that differ in at least one characteristic (height, width, length), the exposed ceiling can be created to have a different aesthetic.

Furthermore, in FIG. 7C the panel 200*b* is adjacent to one of the panels 200*d*. The panel 200*b* is mounted to the carrier component 100 via engagement with the third and fourth ledges 181, 182 of two of the support members 150 and the panel 200*d* is mounted to the carrier component 100 via engagement with the first and second ledges 161, 162 of one of the support members 150. Thus, an uppermost edge 209*b* of the panel 200*b* is located at a first axial position along the support member(s) 150 to which it is mounted. Furthermore, an uppermost edge 209*d* of the panel 200*d* is located at a second axial position along the support member(s) 150 to which it is mounted. In the exemplified embodiment, the second axial position is closer to the distal end 151 of the support member(s) 150 than the first axial position because the first and second ledges 161, 162 are located closer to the distal end 151 of the support member 150 than the third and fourth ledges 181, 182. In the exemplified embodiment, the bottom surfaces of the panels 200*b*, 200*d* are aligned and planar. Thus, in this example the panel 200*b* has a greater height than the panel 200*d*. However, if it were the case than the panels 200*b*, 200*d* had the same height (measured from the bottom wall to the distal-most end of the panel 200*b*, 200*d* formed by either the sidewalls or the flanges), the panel 200*d* would extend lower (i.e., further into the interior space) than the panel 200*b* by virtue of it being coupled to the first and second ledges 161, 162 which are lower down on the supporting member 150 than the third and fourth ledges 181, 182.

Figure 8:
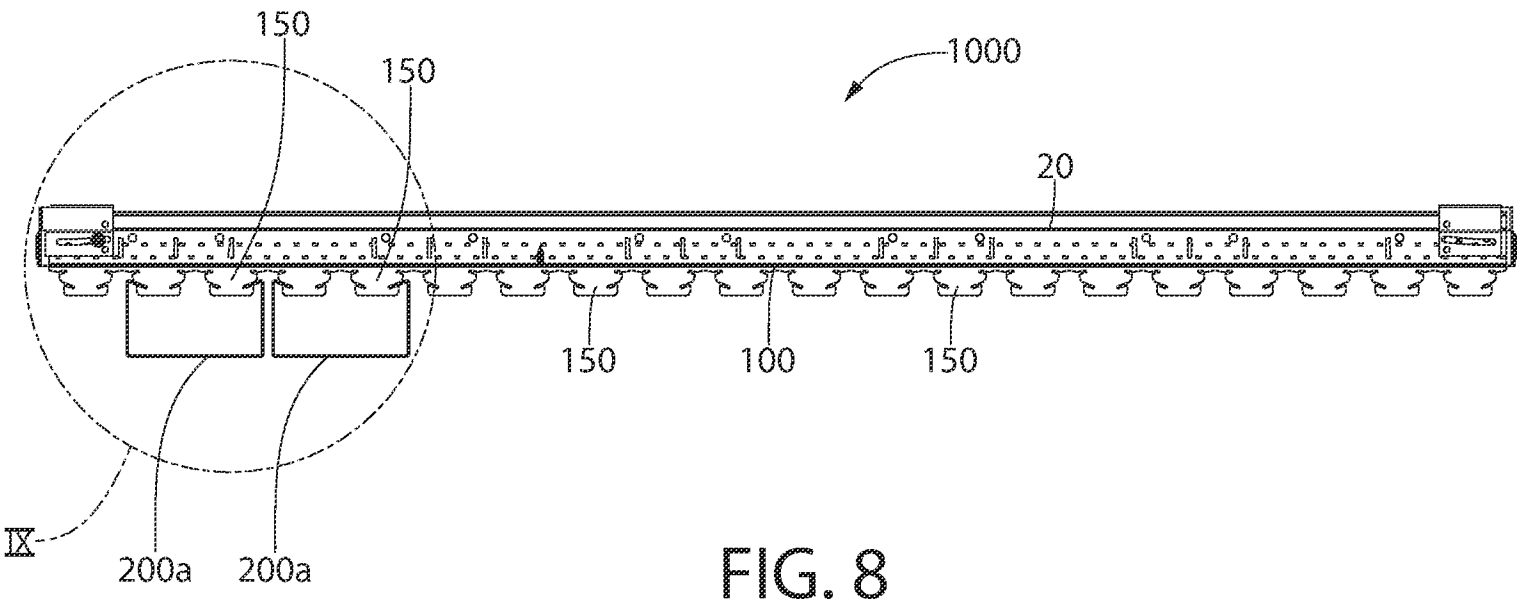
FIG. 8 is a front view of the ceiling system including the main beam, the carrier component coupled to the main beam, and a plurality of ceiling panels mounted to the carrier component.
Figure 9:
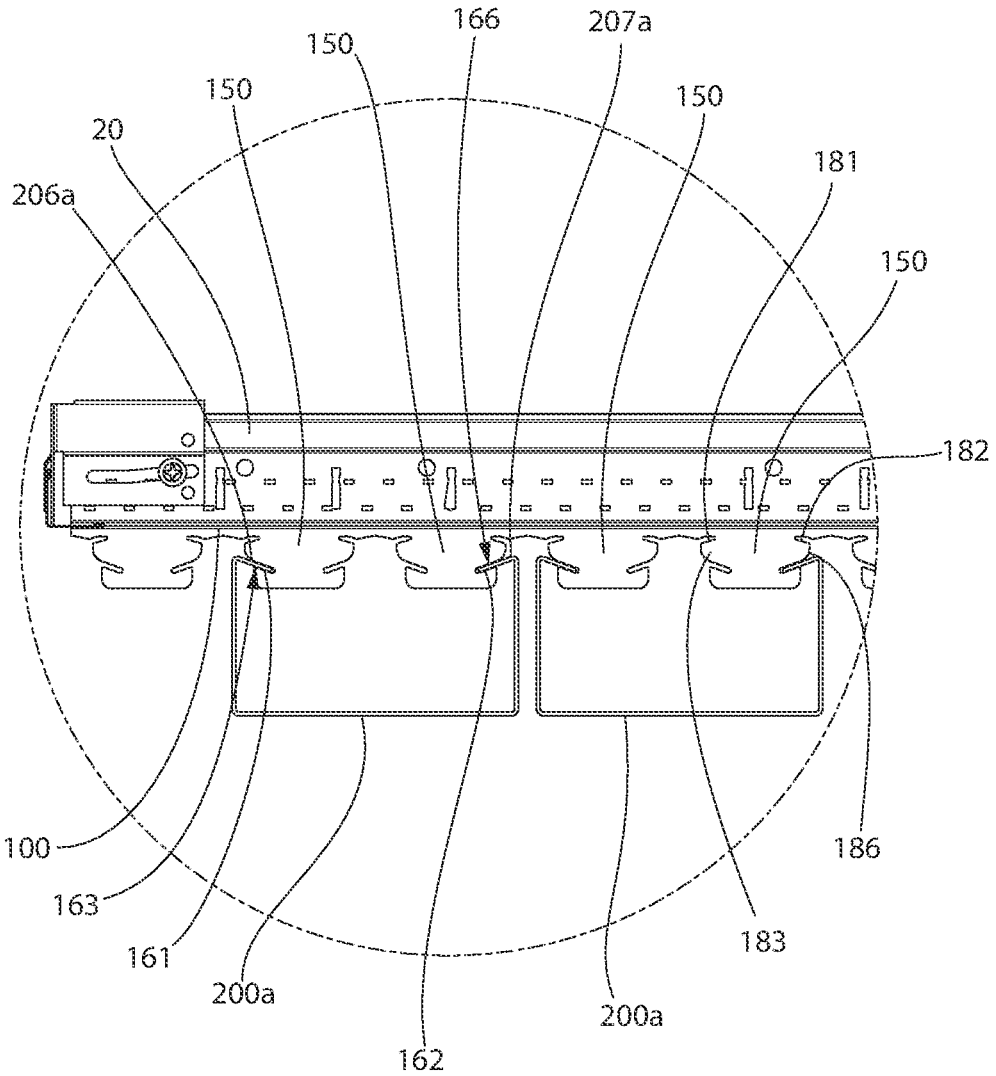
FIG. 9 is a close-up view of area IX of FIG. 8.

Referring to FIGS. 8 and 9, the ceiling system 1000 is illustrated showing the main beam 20, the carrier component 100 mounted to the main beam 20, and two of the panels 200*a* mounted to the carrier component 100. In a fully assembled/installed ceiling system 1000, all of the support members 150 of the carrier component 100 will be covered by the panels 200*a* (or the panels 200*a* in combination with any other type of panel that is configured to be coupled/mounted to the carrier component 100 as has been described herein). In FIGS. 8 and 9, the first and second flanges 206*a*, 207*a* of the panel 200*a* are nested within the first and second notches 163, 166 of the support member 150 so as to be in engagement with the first and second ledges 161, 162 of the support member 150. In other embodiments, one or more of the panels 200*a* could have mounting elements that nest within the third and fourth notches 183, 186 so as to be in engagement with the third and fourth ledges 181, 182 of the support member 150. Furthermore, in the exemplified embodiment the panels 200*a* are mounted to two adjacent ones of the support members 150. In other embodiments, the panels 200*a* could be mounted to any two of the support members 150 even if not adjacent or the panels 200*a* could be mounted to a single one of the support members 150, as has been described herein above with particular reference to FIG. 7C.

FIGS. 10A-15B illustrate alternative embodiments for carrier components in accordance with the invention described herein. The carrier components shown in FIGS. 10A-15B are identical to the carrier component 100 described herein above except for differences that are specifically described and/or explicitly shown in the drawings. Thus, for features of the carrier components shown in FIGS. 10A-15B that are not described in detail, it should be appreciated that the description of the carrier component 100 is applicable. The features of the carrier components in FIGS. 10A-15B will be numbered in an identical manner to the features of the carrier component 100 described above except that a suffix "a" through "h" will be used consistently within each embodiment. Thus, the corresponding components will be readily appreciated and understood.

Figure 10A:
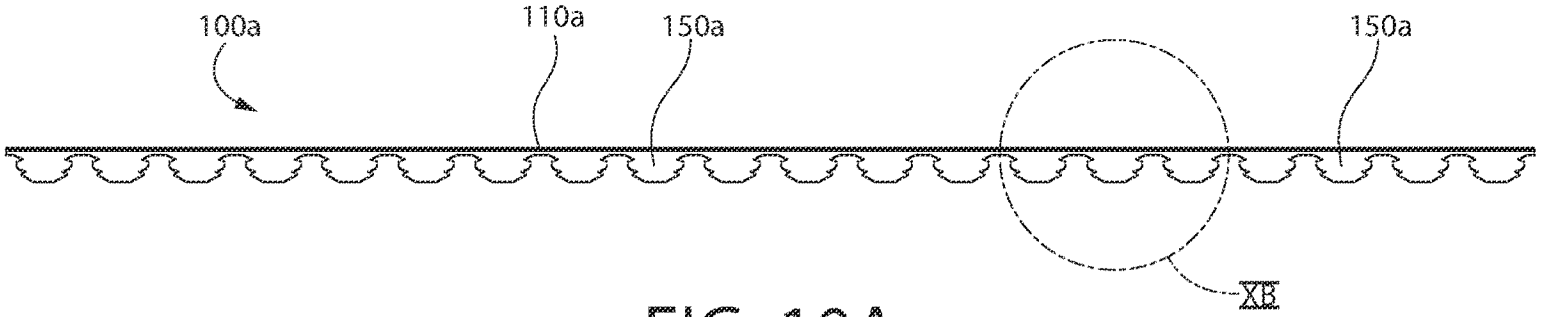
FIG. 10A is a front view of a carrier component in accordance with a first alternative embodiment of the present invention.
Figure 10B:
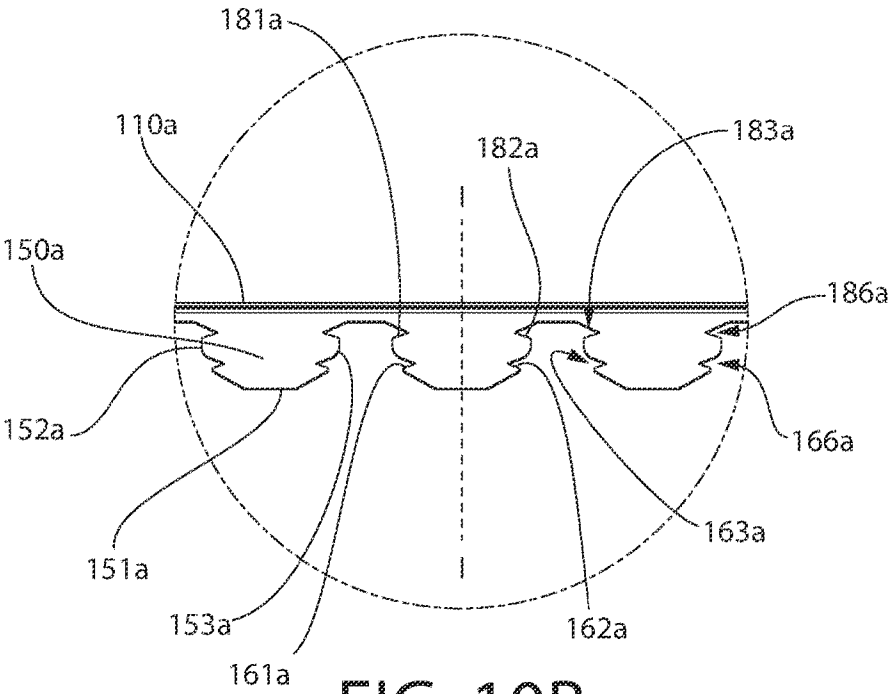
FIG. 10B is a close-up of area XB of FIG. 10A.

FIGS. 10A and 10B illustrate a carrier component 100*a* comprising a body portion 110*a* and a plurality of support members 150*a* extending downwardly from the carrier component 100*a* in a spaced apart manner. The carrier component 100*a* is identical to the carrier component 100 except with regard to the configuration of the notches and ledges of the support member 150*a*, as described further below.

The support member 150*a* extends from the body portion 110*a* to a distal end 151*a* along a longitudinal axis I-I. The support member 150*a* comprises a first side edge 152*a* and a second side edge 153*a* located on opposite sides of the longitudinal axis I-I. The support member 150*a* comprises a first notch 163*a* in the first side edge 152*a* that defines a first ledge 161*a*, a second notch 166*a* in the second side edge 153*a* that defines a second ledge 162*a*, a third notch 183*a* in the first side edge 152*a* that defines a third ledge 181*a*, and a fourth notch 186*a* in the second side edge 153*a* that defines a fourth ledge 182*a*. As with the carrier component 100, in this embodiment the first and second notches 163*a*, 166*a* and hence also the first and second ledges 161*a*, 162*a* are axially aligned along the support member 150*a*, Similarly, the third and fourth notches 183*a*, 186*a* and hence also the third and fourth ledges 181*a*, 182*a* are axially aligned along the support member 150*a*.

However, in this embodiment the first and third ledges 161*a*, 181*a* are angled in the same direction (upwardly away from the distal end 151*a* as they extend further from the first side edge 152*a*) and the second and third ledges 162*a*, 182*a* are angled in the same direction (upwardly away from the distal end 151*a* as they extend further from the second side edges 153*a*). In such an embodiment, the same panel may be able to be coupled to either the first and second ledges 161*a*, 162*a* or to the third and fourth ledges 181*a*, 182*a*, which was not possible with the earlier described embodiment.

Figure 11A:
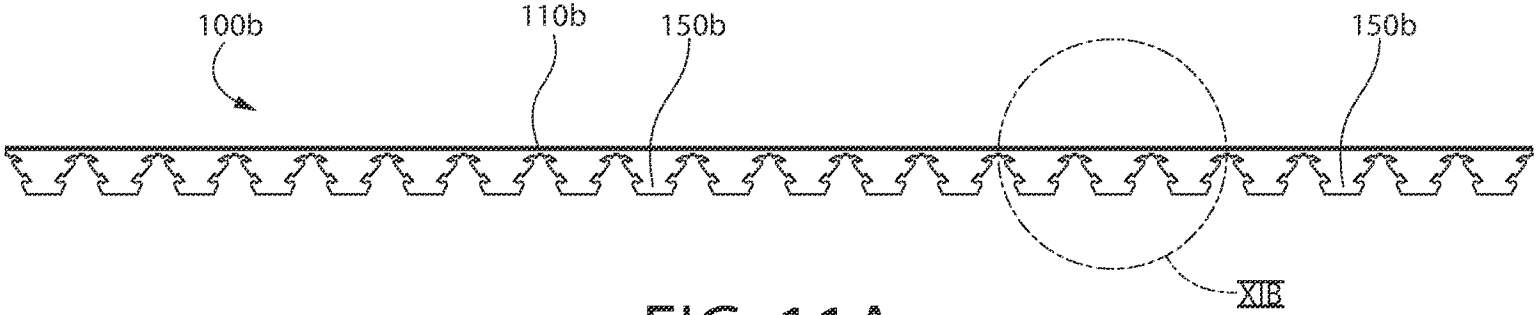
FIG. 11A is a front view of a carrier component in accordance with a second alternative embodiment of the present invention.
Figure 11B:
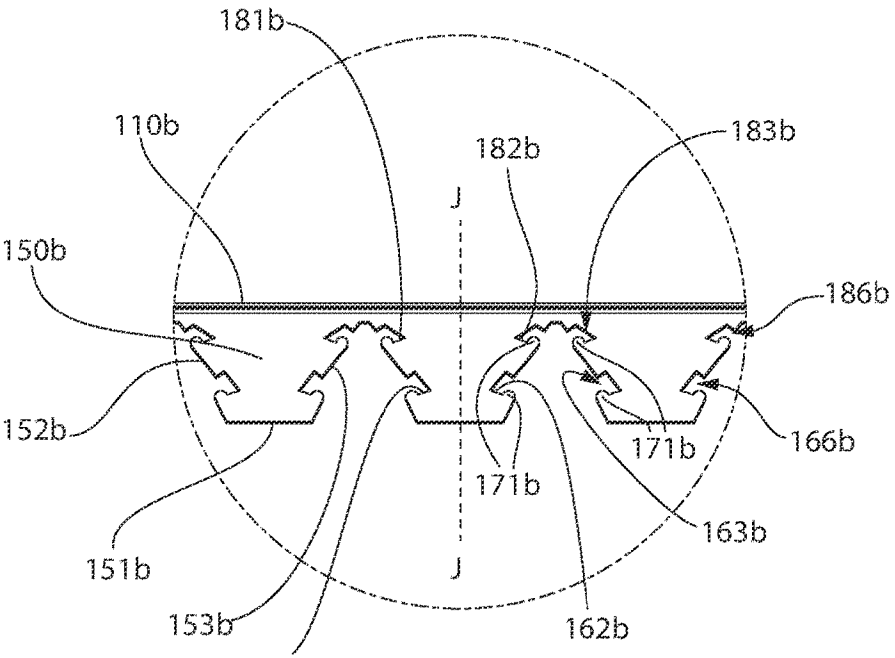
FIG. 11B is a close-up of area XIB of FIG. 11A.

FIGS. 11A and 11B illustrate a carrier component 100*b* comprising a body portion 110*b* and a plurality of support members 150*b* extending downwardly from the carrier component 100*b* in a spaced apart manner. The carrier component 100*b* is identical to the carrier component 100 except with regard to the configuration of the notches and ledges of the support member 150*b*, as described further below.

The support member 150*b* extends from the body portion 110*b* to a distal end 151*b* along a longitudinal axis J-J. The support member 150*b* comprises a first side edge 152*b* and a second side edge 153*b* located on opposite sides of the longitudinal axis J-J. The support member 150*b* comprises a first notch 163*b* in the first side edge 152*b* that defines a first ledge 161*b*, a second notch 166*b* in the second side edge 153*b* that defines a second ledge 162*b*, a third notch 183*b* in the first side edge 152*b* that defines a third ledge 181*b*, and a fourth notch 186*b* in the second side edge 153*b* that defines a fourth ledge 182*b*. As with the carrier component 100, in this embodiment the first and second notches 163*b*, 166*b* and hence also the first and second ledges 161*b*, 162*b* are axially aligned along the support member 150*b*. Similarly, the third and fourth notches 183*b*, 186*b* and hence also the third and fourth ledges 181*b*, 182*b* are axially aligned along the support member 150*b*.

However, in this embodiment the notches 163*b*, 166*b*, 183*b*, 186*b* have a different shape, such that there is a stopper protuberance 171*b* located at an end of each of the ledges 161*b*, 162*b*, 181*b*, 182*b* adjacent to the opening of the respective one of the notches 163*b*, 166*b*, 183*b*, 186*b*. Each of the stopper protuberances 171*b* extends upwardly from one of the ledges 161*b*, 162*b*, 181*b*, 182*b* adjacent to one of the first and second side edges 152*b*, 153*b* of the support member 150*b*. Thus, the stopper protuberances 171*b* may assist in preventing a panel that is mounted to the carrier component 100*b* from becoming readily disengaged therefrom without deliberate user interaction.

Figure 12A:
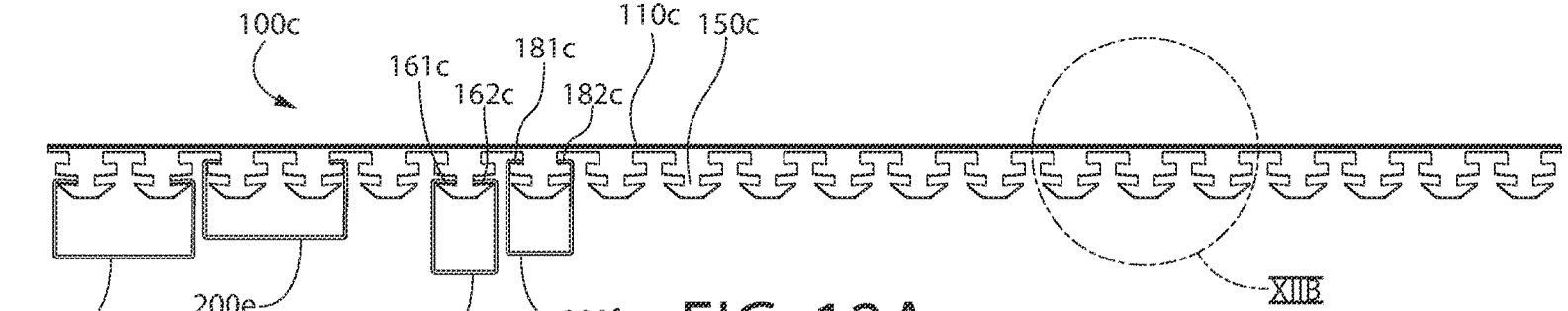
FIG. 12A is a front view of a carrier component in accordance with a third alternative embodiment of the present invention.
Figure 12B:
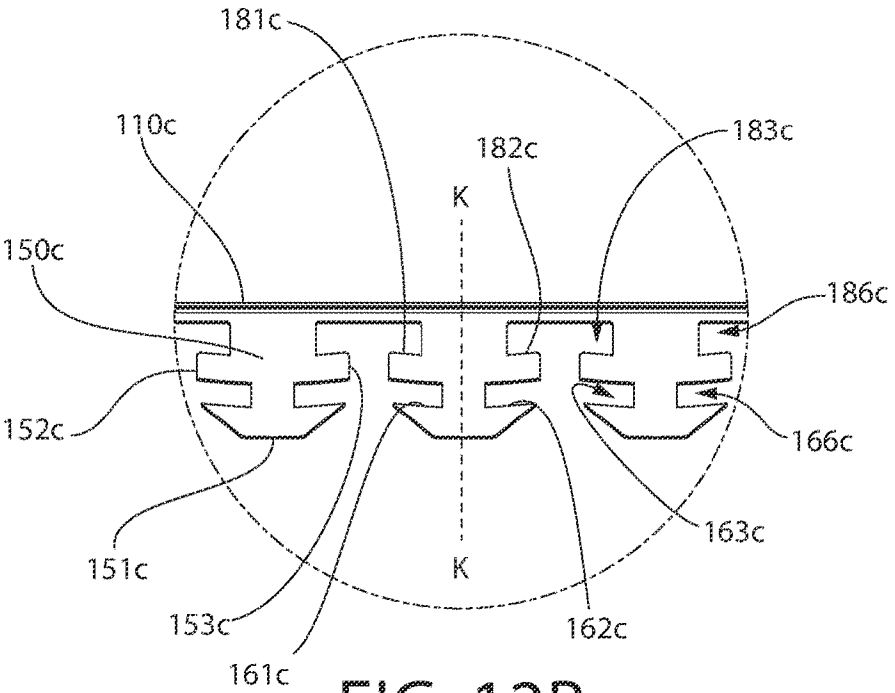
FIG. 12B is a close-up of area XIIB of FIG. 12A.

FIGS. 12A and 12B illustrate a carrier component 100*c* comprising a body portion 110*c* and a plurality of support members 150*c* extending downwardly from the carrier component 100*c* in a spaced apart manner. The carrier component 100*c* is identical to the carrier component 100 except with regard to the configuration of the notches and ledges of the support member 150*c*, as described further below.

The support member 150*c* extends from the body portion 110*c* to a distal end 151*c* along a longitudinal axis K-K. The support member 150*c* comprises a first side edge 152*c* and a second side edge 153*c* located on opposite sides of the longitudinal axis K-K. The support member 150*c* comprises a first notch 163*c* in the first side edge 152*c* that defines a first ledge 161*c*, a second notch 166*c* in the second side edge 153*c* that defines a second ledge 162*c*, a third notch 183*c* in the first side edge 152*c* that defines a third ledge 181*c*, and a fourth notch 186*c* in the second side edge 153*c* that defines a fourth ledge 182*c*. As with the carrier component 100, in this embodiment the first and second notches 163*c*, 166*c* and hence also the first and second ledges 161*c*, 162*c* are axially aligned along the support member 150*c*. Similarly, the third and fourth notches 183*c*, 186*c* and hence also the third and fourth ledges 181*c*, 182*c* are axially aligned along the support member 150*c*.

However, whereas in previous embodiments the ledges have all been sloped relative to the longitudinal axis of the support member, in this embodiment the ledges 161*c*, 162*c*, 181*c*, 182*c* are oriented perpendicular relative to the longitudinal axis K-K of the support member 150*c*. Moreover, in this embodiment, as with the embodiments of FIGS. 10A-11B, the same type of panel can be mounted to the first and second ledges 161*c*, 162*c* of one or more of the support members 150*c* or to the third and fourth ledges 181*c*, 182*c* of one or more of the support members 150*c*. This is best depicted in FIG. 12A. The reason that the same type of panel can be mounted to the first and second ledges 161*c*, 162*c*, or to the third and fourth ledges 181*c*, 182*c* is because the first and third ledges 161*c*, 181*c*, and the second and fourth ledges 162*c*, 182*c* all have the same structure and orientation. Thus, if mounting elements on the panels are able to matingly engage the first and second ledges 161*c*, 162*c*, they will similarly be able to matingly engage the third and fourth ledges 181*c*, 182*c*.

Specifically, FIG. 12A shows a first type of panel 200*e* mounted to the carrier component 100*c* and a second type of panel 200*f* mounted to the carrier component 100*c*. The first type of panel 200*e* is illustrated as being mounted to the carrier component 100*c* via engagement with the first ledge 161*c* of one of the support members 150*c* and the second ledge 162*c* of another one of the support members 150*c*. Furthermore, another one of the first type of panel 200*e* is illustrated being mounted to the carrier component 100*c* via engagement with the third ledge 181*c* of one of the support members 150*c* and the fourth ledge 182*c* of another one of the support members 150*c*. Thus, the first type of panel 200*e* is able to be mounted to the carrier component 100*c* at two different heights, which creates a non-planar exposed ceiling surface. This is because the two first types of panel 200*e* are completely identical in every respect, but hung at different axial positions along the support members 150*c* of the carrier component 100*c*. Thus, using the same carrier component 100*c* and a plurality of identical panels (i.e., the first type of panel 200*e*), an enhanced aesthetic can be created.

FIG. 12A also illustrates the second type of panel 200*f* coupled to the support members 150*c* of the carrier component 100*c* at two different axial positions along the support members 150*c*. The difference between the second type of panel 200*f* as compared with the first type of panel 200*e* is that the second type of panel 200*f* is mounted to a single one of the support members 150*c* rather than to two of the support members 150*c*. Otherwise, the same concept is being shown, which is that the second type of panel 200*f* can be mounted to the carrier component 100*c* at two different axial positions along a length of the support members 150*c*.

Figure 13A:
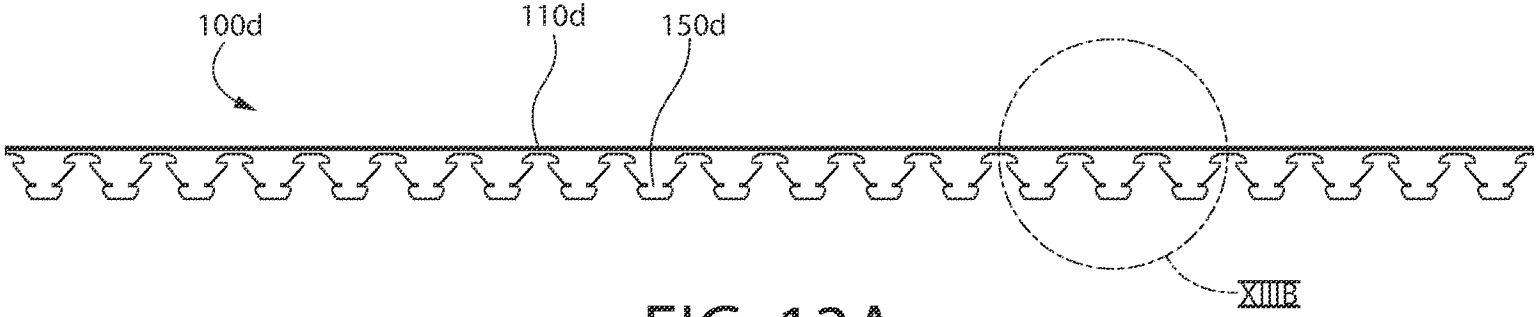
FIG. 13A is a front view of a carrier component in accordance with a fourth alternative embodiment of the present invention, wherein a plurality of ceiling panels are mounted to the carrier component at different axial positions.
Figure 13B:
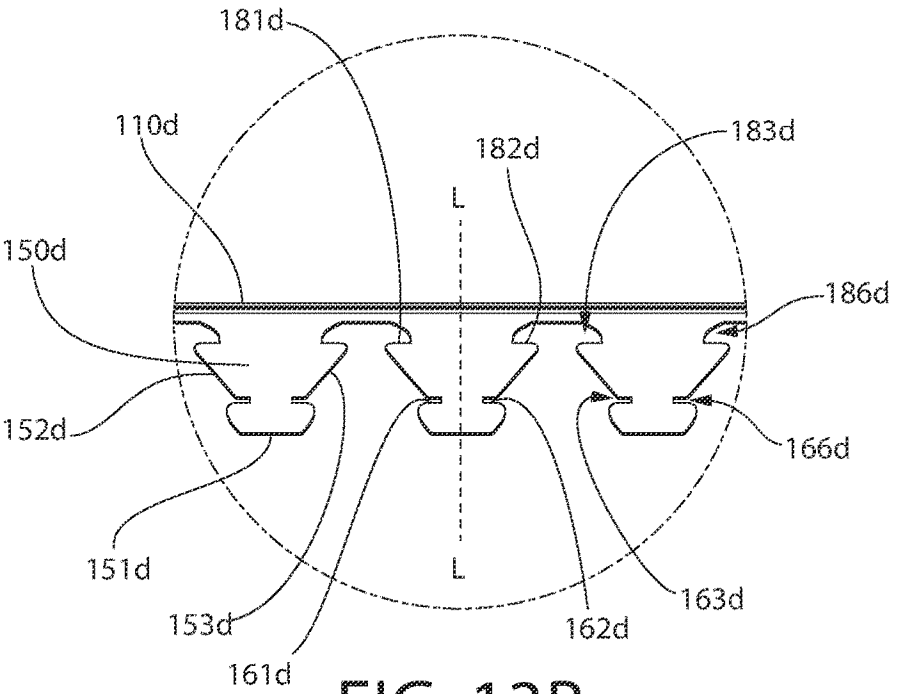
FIG. 13B is a close-up view of area XIIIB of FIG. 13A.

FIGS. 13A and 13B illustrate a carrier component 100*d* comprising a body portion 110*d* and a plurality of support members 150*d* extending downwardly from the carrier component 100*d* in a spaced apart manner. The carrier component 100*d* is identical to the carrier component 100 except with regard to the configuration of the notches and ledges of the support member 150*d*, as described further below.

The support member 150*d* extends from the body portion 110*d* to a distal end 151*d* along a longitudinal axis L-L. The support member 150*d* comprises a first side edge 152*d* and a second side edge 153*d* located on opposite sides of the longitudinal axis L-L. The support member 150*d* comprises a first notch 163*d* in the first side edge 152*d* that defines a first ledge 161*d*, a second notch 166*d* in the second side edge 153*d* that defines a second ledge 162*d*, a third notch 183*d* in the first side edge 152*d* that defines a third ledge 181*d*, and a fourth notch 186*d* in the second side edge 153*d* that defines a fourth ledge 182*d*. As with the carrier component 100, in this embodiment the first and second notches 163*d*, 166*d* and hence also the first and second ledges 161*d*, 162*d* are axially aligned along the support member 150*d*. Similarly, the third and fourth notches 183*d*, 186*d* and hence also the third and fourth ledges 181*d*, 182*d* are axially aligned along the support member 150*d*.

In this embodiment, the first, second, third, and fourth ledges 161*d*, 162*d*, 181*d*, 182*d* are all oriented perpendicularly to the longitudinal axis L-L of the support member 150*d*. However, the main difference between this embodiment and that of the carrier component 100*c*, for example, is that the first and second notches 163*d*, 166*d* have a smaller height (measured in a direction of the longitudinal axis L-L) than the third and fourth notches 183*d*, 186*d*. Thus, in some embodiments certain panels may not be able to be mounted to the first and second ledges 161*d*, 162*d* if mounting elements thereof are unable to be inserted into the first and second notches 163*d*, 166*d*.

Figure 14A:
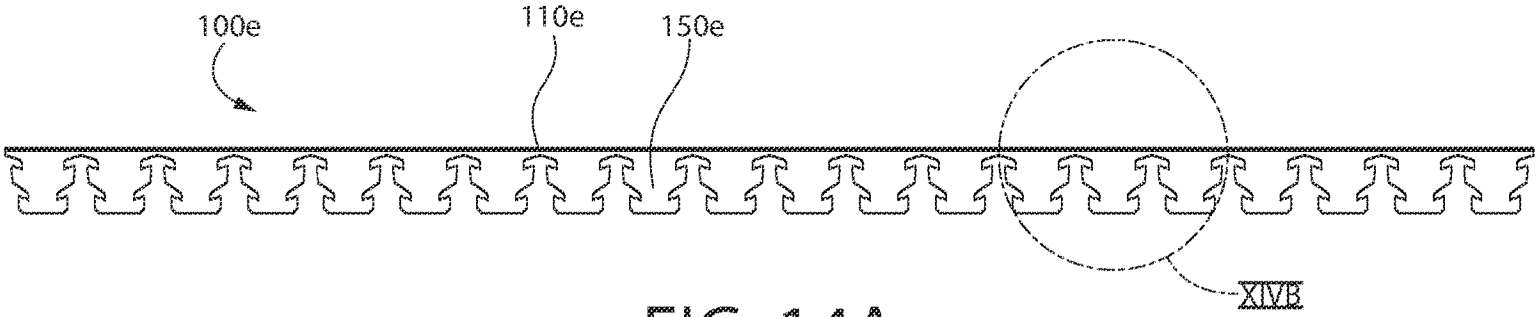
FIG. 14A is a front view of a carrier component in accordance with a fifth alternative embodiment of the present invention.
Figure 14B:
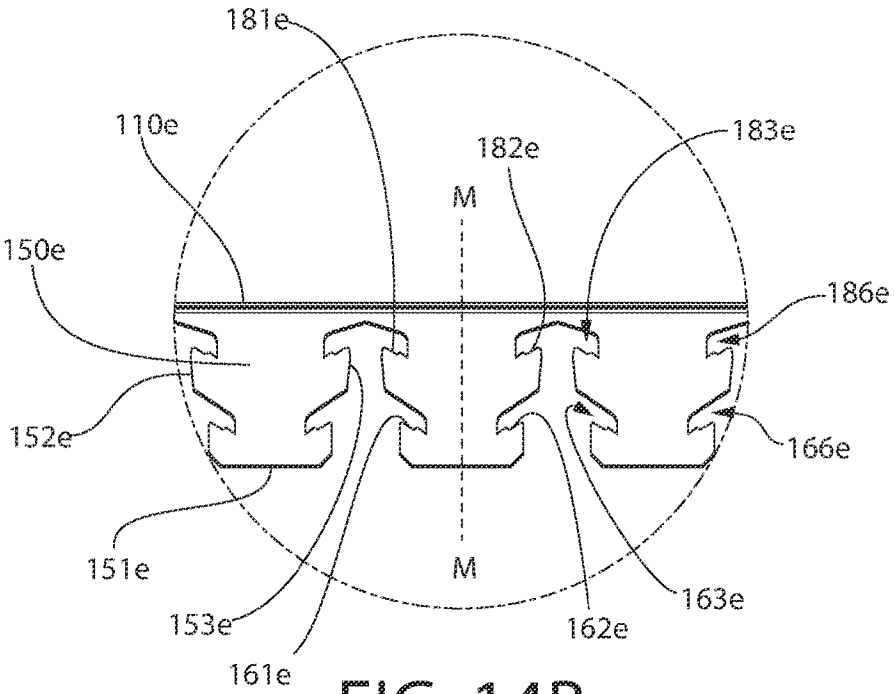
FIG. 14B is a close-up view of area XIVB of FIG. 14A.

FIGS. 14A and 14B illustrate a carrier component 100*e* comprising a body portion 110*e* and a plurality of support members 150*e* extending downwardly from the carrier component 100*e* in a spaced apart manner. The carrier component 100*e* is identical to the carrier component 100 except with regard to the configuration of the notches and ledges of the support member 150*e*, as described further below.

The support member 150*e* extends from the body portion 110*e* to a distal end 151*e* along a longitudinal axis M-M. The support member 150*e* comprises a first side edge 152*e* and a second side edge 153*e* located on opposite sides of the longitudinal axis M-M. The support member 150*e* comprises a first notch 163*e* in the first side edge 152*e* that defines a first ledge 161*e*, a second notch 166*e* in the second side edge 153*e* that defines a second ledge 162*e*, a third notch 183*e* in the first side edge 152*e* that defines a third ledge 181*e*, and a fourth notch 186*e* in the second side edge 153*e* that defines a fourth ledge 182*e*. As with the carrier component 100, in this embodiment the first and second notches 163*e*, 166*e* and hence also the first and second ledges 161*e*, 162*e* are axially aligned along the support member 150*e*. Similarly, the third and fourth notches 183*e*, 186*e* and hence also the third and fourth ledges 181*e*, 182*e* are axially aligned along the support member 150*e*.

In this embodiment, each of the first, second, third, and fourth ledges 161*e*, 162*e*, 181*e*, 182*e* are angled to extend downwardly towards the distal end 151*e* of the support member 150*e* as they extend further from the respective one of the first and second side edges 152*e*, 153*e* in which they are located. Furthermore, each of the first, second, third, and fourth ledges 161*e*, 162*e*, 181*e*, 182*e* are multi-level ledges such that they include a lower ledge portion and an upper ledge portion.

Figure 15A:
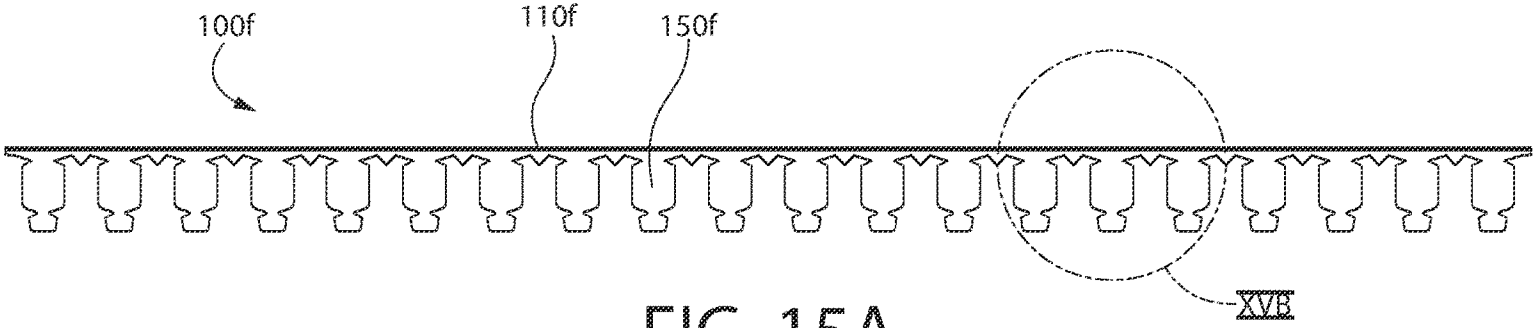
FIG. 15A is a front view of a carrier component in accordance with a sixth alternative embodiment of the present invention.
Figure 15B:
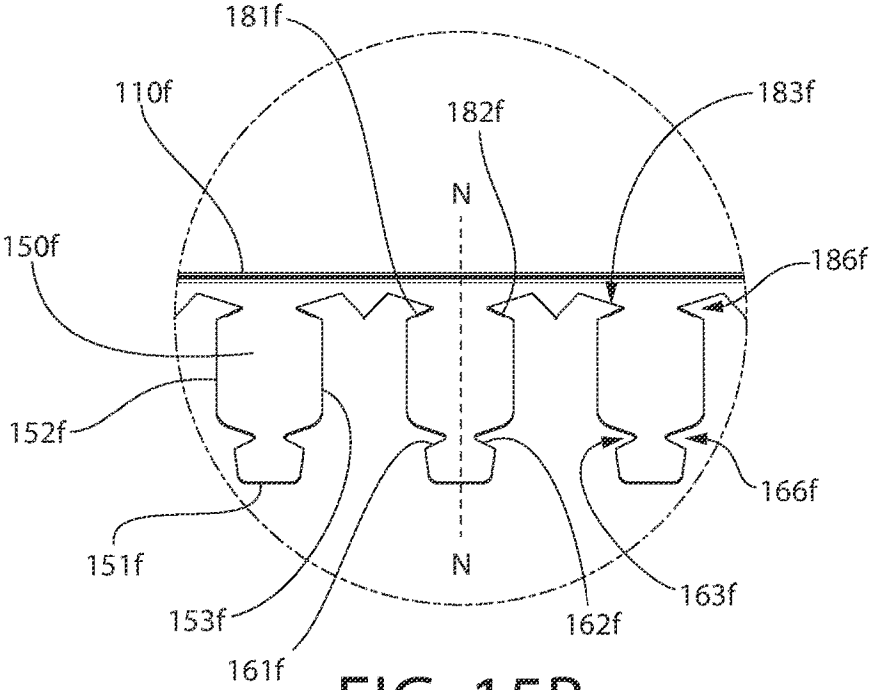
FIG. 15B is a close-up view of area XVB of FIG. 15A.

Finally, FIGS. 15A and 15B illustrate a carrier component 100*f* comprising a body portion 110*f* and a plurality of support members 150*f* extending downwardly from the carrier component 100*f* in a spaced apart manner. The carrier component 100*f* is identical to the carrier component 100 except with regard to the configuration of the notches and ledges of the support member 150*f*, as described further below.

The support member 150*f* extends from the body portion 110*f* to a distal end 151*f* along a longitudinal axis N-N. The support member 150*f* comprises a first side edge 152*f* and a second side edge 153*f* located on opposite sides of the longitudinal axis N-N. The support member 150*f* comprises a first notch 163*f* in the first side edge 152*f* that defines a first ledge 161*f*, a second notch 166*f* in the second side edge 153*f* that defines a second ledge 162*f*, a third notch 183*f* in the first side edge 152*f* that defines a third ledge 181*f*, and a fourth notch 186*f* in the second side edge 153*f* that defines a fourth ledge 182*f*. As with the carrier component 100, in this embodiment the first and second notches 163*f*, 166*f* and hence also the first and second ledges 161*f*, 162*f* are axially aligned along the support member 150*f*. Similarly, the third and fourth notches 183*e*, 186*e* and hence also the third and fourth ledges 181*e*, 182*e* are axially aligned along the support member 150*e*.

Furthermore, as discussed above with the carrier component 100, for each of the carrier components 100*a*-100*f*, the first and second ledges 161*a-f*, 162*a-f* terminate at a position along the respective support member 150*a-f* that is closer to the longitudinal axis of that support member 150*a-f* than the position that the third and fourth ledges 181*a-f*, 182*a-f* terminate. Stated another way, a distance measured from the longitudinal axis of the support member 150*a-f* to the first ledge 161*a-f* is less than a distance measured from the longitudinal axis of the support member 150*a-f* to the third ledge 181*a-f*. Similarly, a distance measured from the longitudinal axis of the support member 150*a-f* to the second ledge 162*a-f* is less than a distance measured from the longitudinal axis of the support member 150*a-f* to the fourth ledge 182*a-f*. Although this is shown in all embodiments, in other embodiments the first and third ledges 161*a-f* may terminate at a position that is the same distance from the longitudinal axis of the support member 150*a-f* and the second and third ledges 161*a-f* may terminate at a position that is the same distance from the longitudinal axis of the support member 150*a-f*. In still other embodiments, the third ledges 162*a-f* may terminate at a position that is closer to the longitudinal axis of the support member 150*a-f* than the first ledges 161*a-f* and the fourth ledges 182*a-f* may terminate at a position that is closer to the longitudinal axis of the support member 150*a-f* than the second ledges 162*a-f*. Thus, some variation in the structure is possible in accordance with the invention described herein.

The carrier components 100 described herein may be formed from metal in some embodiments. For example, the carrier components 100 may be stamped from a piece of sheet metal and then bent at right angles (or substantially right angles, which is plus or minus 5°) so that the support members 150 extend downwardly from the body portions 110 of the carrier components. Thus, the carrier components 100 may first be stamped using a stamping press to form the metal into a desired shape by removing portions of the carrier components 100 to define the support members 150. Next, portions of the carrier components 100 can be bent relative to the body portion 110 to form the generally U-like shape of the carrier component 100. Furthermore, although described herein as being formed from metal, the invention is not to be so limited in all embodiments and the carrier components 100 could be formed from other materials including plastic, polystyrene, wood, or the like so long as the carrier component 100 is sufficiently rigid to enable it to support the panels 200 as described herein. Of course, other techniques for forming the carrier components 100 may be possible in other embodiments including extrusion, injection molding, forging, or the like.

The panels 200 described herein may be formed from metal, plastic, fabric, acoustical materials, thermal materials, or the like. Thus, any type of panel currently used for ceiling or wall coverings can be used in accordance with the invention set forth herein.

As can be seen from this disclosure, the invention provides a solution to the problem of having to manufacture, inventory, and supply different carriers for each panel size and provides a solution to the problem of cut end panels not being securely fastened to the carrier.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A carrier component configured to support one or more panels of a ceiling system, the carrier component comprising:

a body portion extending along a first longitudinal axis;

a plurality of support members extending from the body portion and arranged in a spaced apart manner along the first longitudinal axis, each of the support members extending along a second longitudinal axis and comprising:

a distal end;

a first ledge and a second ledge located on opposite sides of the second longitudinal axis; and a third ledge and a fourth ledge located on opposite sides of the second longitudinal axis, the third and fourth ledges being located further from the distal end than the first and second ledges; and wherein the first and second ledges are angled so that a distance from the first and second ledges to the distal end of the support member increases as the first and second ledges are located further from the second longitudinal axis of the support member, and wherein the third and fourth ledges are angled so that a distance from the third and fourth ledges to the distal end of the support member decreases as the third and fourth ledges are located further from the second longitudinal axis of the support member.

2. The carrier component according to claim 1 wherein the first and second ledges are intersected by a first transverse axis that is perpendicular to the second longitudinal axis of the support member and wherein the third and fourth ledges are intersected by a second transverse axis that is perpendicular to the second longitudinal axis of the support member, the first transverse axis being located closer to the distal end of the support member than the second transverse axis.

3. The carrier component according to claim 1 wherein the first ledge extends along a first ledge axis and the second ledge extends along a second ledge axis, a distance between the distal end of the support member and the first and second ledge axes decreasing as a distance between the first and second ledge axes and the second longitudinal axis decreases, and wherein the third ledge extends along a third ledge axis and the fourth ledge extends along a fourth ledge axis, a distance between the distal end of the support member and the third and fourth ledge axes increasing as a distance between the third and fourth ledge axes and the second longitudinal axis decreases.

4. The carrier component according to claim 1 wherein each of the support members comprise a first side edge and a second side edge located on opposite sides of the second longitudinal axis, a first notch in the first side edge that defines the first ledge, a second notch in the second side edge that defines the second ledge, a third notch in the first side edge that defines the third ledge, and a fourth notch in the second side edge that defines the fourth second ledge.

5. The carrier component according to claim 4 wherein a central portion of the first side edge extends between the first and third notches such that the first and third notches have distinct openings in the first side edge, and wherein a central portion of the second side edge extends between the second and fourth notches such that the second and fourth notches have distinct openings in the second side edge.

6. The carrier component according to claim 4 wherein each of the support members comprises a front surface and an opposite rear surface, and wherein each of the first, second, third, and fourth notches extends through the support member from the front surface to the rear surface.

7. The carrier component according to claim 1 wherein the first and second ledges are configured to engage a mounting element of a first type of panel to support the first type of panel from the support members, and wherein the third and fourth ledges are configured to engage a mounting element of a second type of panel to support the second type of panel from the support members, the first and second types of panels being different.

8. The carrier component according to claim 7 wherein the first and second ledges are configured to prevent and prohibit engagement with the mounting element of the second type of panel, and wherein the third and fourth ledges are configured to prevent and prohibit engagement with the mounting element of the first type of panel.

9. The carrier component according to claim 1 wherein an end of the first ledge that is closest to the second longitudinal axis is located at a first distance from the second longitudinal axis and wherein an end of the third ledge that is closest to the second longitudinal axis is located at a second distance from the second longitudinal axis, the second distance being greater than the first distance.

10. The carrier component according to claim 9 wherein an end of the second ledge that is closest to the second longitudinal axis is located at the first distance from the second longitudinal axis and wherein an end of the fourth ledge that is closest to the second longitudinal axis is located at the second distance from the second longitudinal axis.

11. The carrier component according to claim 1 wherein a maximum distance measured from the first and second ledges to the distal end is less than a maximum distance measured from the third and fourth ledges to the distal end.

12. A carrier component configured to support one or more panels of a ceiling system, the carrier component comprising:

a body portion extending along a first longitudinal axis; and a first support member extending from the body portion along a second longitudinal axis, the first support member comprising a distal end, a first ledge located on a first side of the second longitudinal axis, and a second ledge located on the first side of the second longitudinal axis, the first ledge being located closer to the distal end of the first support member than the second ledge;

a second support member extending from the body portion along a third longitudinal axis, the second support member comprising a distal end, a third ledge located on a second side of the third longitudinal axis, and a fourth ledge located on the second side of the third longitudinal axis, the third ledge being located closer to the distal end of the second support member than the fourth ledge;

wherein the second support member is located on a second side of the second longitudinal axis of the first support member and the first support member is located on a first side of the third longitudinal axis of the second support member, the first and second support members being spaced apart from one another along the first longitudinal axis of the body portion; and wherein the second ledge of the first support member is angled upwardly moving in a direction towards the second longitudinal axis and wherein the fourth ledge of the second support member is angled upwardly moving in a direction towards the third longitudinal axis.

13. The carrier component according to claim 12 wherein the first and second support members are configured to support a first type of panel via engagement of the first type of panel with the first ledge of the first support member and the third ledge of the second support member, and wherein the first and second support members are configured to support a second type of panel via engagement of the second type of panel with the second ledge of the first support member and the fourth ledge of the second support member.

14. The carrier component according to claim 12 wherein an end of the second ledge that is located closest to the second longitudinal axis is further from the second longitudinal axis than an end of the first ledge that is located closest to the second longitudinal axis.

15. The carrier component according to claim 14 wherein an end of the fourth ledge that is located closest to the third longitudinal axis is further from the third longitudinal axis than an end of the third ledge that is located closest to the third longitudinal axis.

16. The carrier component according to claim 12 wherein the first ledge of the first support member is angled downwardly moving in the direction towards the second longitudinal axis and wherein the third ledge of the second support member is angled downwardly moving in the direction towards the third longitudinal axis.

17. A carrier component configured to support one or more panels of a ceiling system, the carrier component comprising:

a body portion extending along a first longitudinal axis; and a plurality of support members extending from the body portion and arranged in a spaced apart manner along the first longitudinal axis, each of the support members extending along a second longitudinal axis and comprising:

a distal end;

a first side edge extending from the distal end in a direction towards the body portion;

a first notch formed into the first side edge and terminating at a first end that is located a first distance from the second longitudinal axis; and a second notch formed into the first side edge and terminating at a second end that is located a second distance from the second longitudinal axis, the second distance being greater than the first distance;

wherein the first and second notches are angled relative to the second longitudinal axis so as to diverge away from one another moving in a direction from the first side edge towards the second longitudinal axis; and wherein each of the first and second notches is configured to receive at least a portion of a mounting element of a panel to mount the panel to the carrier component.

18. The carrier component according to claim 17 wherein the first notch is angled so as to be located closer to the distal end with increasing distance away from the first side edge, and wherein the second notch is angled so as to be located further from the distal end with increasing distance away from the first side edge.

* * * * *